US006676314B2

(12) United States Patent
Tanaka et al.

(10) Patent No.: US 6,676,314 B2
(45) Date of Patent: Jan. 13, 2004

(54) TAPE PRINTING APPARATUS AND METHOD

(75) Inventors: Seiji Tanaka, Nagano-ken (JP); Kiyoshi Ogawa, Tokyo (JP); Hiroshi Ono, Tokyo (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 0 days.

(21) Appl. No.: 10/224,530

(22) Filed: Aug. 20, 2002

(65) Prior Publication Data

US 2003/0077099 A1 Apr. 24, 2003

(30) Foreign Application Priority Data

Aug. 27, 2001 (JP) ..... 2001-256333

(51) Int. Cl.[7] ..... B41J 11/44

(52) U.S. Cl. ..... 400/615.2; 400/61; 400/70; 400/76; 400/621

(58) Field of Search ..... 400/615.2, 621, 400/76, 70, 61

(56) References Cited

U.S. PATENT DOCUMENTS 3,970,230 A * 7/1976 Horn ..... 225/65
5,222,818 A * 6/1993 Akiyama et al. ..... 400/61
5,409,317 A * 4/1995 Ueno et al. ..... 400/61
6,120,200 A * 9/2000 Watanabe et al. ..... 400/615.2
6,270,269 B1 * 8/2001 Watanabe et al. ..... 400/615.2

FOREIGN PATENT DOCUMENTS

JP 05-301395 11/1993

* cited by examiner

*Primary Examiner*—Charles H. Nolan, Jr.
(74) *Attorney, Agent, or Firm*—Hogan & Hartson, LLP

(57) ABSTRACT

There is provided a tape printing apparatus and method that enables reliable discharge of a cut-off tape strip from the apparatus. Print data to be printed is input, and a tape length tp (tp>0) is calculated based on the input print data. Then, a tape length t is set based on the calculation tape length tp, and a tape is cut to the set tape length t. In the step of setting the tape length, it is determined whether or not the calculation tape length tp is smaller than a length (a+x) obtained by adding a predetermined length x (x≧0) to a length a (a≧0) between a cutting position at which the tape is cut through and a position of an exit via which a cut-off strip of the tape is discharged out of an apparatus. Then, when it is determined that tp<(a+x) holds, the tape length t is set such that t≧(a+x) holds, whereas when it is determined that tp≧(a+x) holds, the tape length t is set such that t=tp holds.

25 Claims, 14 Drawing Sheets

CUTTING POSITION
EXIT POSITION
OUTSIDE APPARATUS
INSIDE APPARATUS
(IN THE CASE OF tp<(a+x))
x
a
T

①FORWARD SHIFT
tp
α
T

②BACKWARD SHIFT
α
tp
T

③CENTERING
β
tp
β
15a
16a

CUTTING POSITION
EXIT POSITION
OUTSIDE APPARATUS
INSIDE APPARATUS
x
a
CHARACTER PORTION
T tp<(a+x)
LEADING MARGIN
TRAILING MARGIN
tp

①CHANGE OF LEADING MARGIN
α

②CHANGE OF TRAILING MARGIN

③UNIFORM CHANGE OF LEADING AND TRAILING MARGINS
β
15a
16a

TAPE PRINTING APPARATUS AND METHOD

BACKGROUND OF THE INVENTION

1. Field of the Invention

This invention relates to a tape printing apparatus and method which is capable of producing a tape strip having a desired tape length by printing on a tape while feeding the tape and then cutting the tape at a trailing end of a printed portion thereof.

2. Prior Art

Conventionally, a tape printing apparatus has been proposed which is capable of generating print data based on characters, such as letters, symbols, and so forth, input by a user, effecting printing on a tape based on the print data, and then cutting the tape at the trailing end of the printed portion thereof such that the printed portion has a length calculated based on the print data, to thereby produce a tape strip (label) having a desired length. In the tape printing apparatus of this type, a cutting position for cutting a tape and a position of an exit via which a cut-off strip of the tape is discharged out of the tape printing apparatus are arranged at locations as close to each other as possible, so as to ensure reliable discharge (natural drop) of the cut-off tape strip.

However, depending on the case, it is necessary to set a length or distance between the cutting position and the exit position to a predetermined length so as to ensure structural safety (i.e. to prevent a cutter blade from being exposed to the outside of the apparatus). Let it be assumed that the length or distance between the cutting position and the exit position is equal to 9 mm as shown in FIGS. 14A to 14C. In this case, when a tape length tp calculated based on print data is large to some degree as shown in FIG. 14A, a cut-off tape strip can be discharged from the apparatus without any problem (with reliability). However, when the calculation tape length tp is short as shown in FIG. 14B, a cut-off tape strip remains in the apparatus without being discharged therefrom. In this case, if a tool, such as a pair of tweezers, for pinching the tape strip by the leading end is provided at hand, the user can pull it out manually by using the tool. However, when the tape tp is excessively short as shown in FIG. 14C, it is impossible to pull out the tape strip. Further, in the latter case, the leading end portion of the tape is difficult to hold or retain in the apparatus, and hence the tape cannot be cut properly, which causes tape jamming at the cutting position.

Similarly, a so-called handy type tape printer having been developed recently as an apparatus which can be used readily anytime and anywhere cannot avoid the above problem related to tape discharge, which causes great inconvenience. Further, when the handy type tape printer is used by a worker working at a high place e.g. for electric work, the worker has to hold the leading end portion of a cut-off tape strip between his/her fingers to prevent the tape strip from falling off. However, if the leading end portion of the cutoff tape strip is too short to be held between the user's fingers as shown in FIG. 14B or 14C, the printer is practically unusable.

SUMMARY OF THE INVENTION

It is an object of the invention to provide a tape printing apparatus and method that enables reliable discharge of a cut-off tape strip from the apparatus.

To attain the above object, according to a first aspect of the invention, there is provided a printing apparatus that is capable of producing a tape strip having a desired tape length by printing on a tape while feeding the tape and then cutting the tape at a trailing end of a printed portion thereof, the tape printing apparatus comprising:

tape feed means for feeding the tape;

printing means for printing on the tape;

print data input means for inputting print data to be printed by the printing means;

tape length-calculating means for calculating a calculation tape length tp (tp>0) based on the print data input via the print data input means;

tape length-setting means for setting a tape length t based on the calculation tape length tp calculated by the tape length-calculating means;

cutter means for cutting the tape to the tape length t set by the tape length-setting means; and determining means for determining whether the calculation tape length tp is smaller than a length (a+x) obtained by adding a predetermined length x ($x \geqq 0$) to a length a ($a \geqq 0$) between a cutting position at which the tape is cut through by the cutter means and a position of an exit via which a cut-off strip of the tape is discharged out of the tape printing apparatus, wherein if the determining means has determined that the calculation tape length tp is smaller than the length (a+x), the tape length-setting means sets the tape length t such that the tape length t becomes equal to or larger than the length (a+x), whereas if the determining means has determined that the tape length t is not smaller than the length (a+x), the tape length-setting means sets the tape length t to the calculation tape length tp.

Further, to attain the above object, according to a second aspect of the invention, there is provided a tape printing method for a tape printing apparatus that is capable of producing a tape strip having a desired tape length by printing on a tape while feeding the tape and then cutting the tape at a trailing end of a printed portion thereof, the tape printing method comprising the steps of:

inputting print data to be printed;

calculating a calculation tape length tp (tp>0) based on the input print data;

determining whether the calculation tape length tp is smaller than a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus;

setting the tape length t such that the tape length t becomes equal to or larger than the length (a+x) if it is determined that the calculation tape length tp is smaller than the length (a+x), and setting the tape length t to the calculation tape length tp if it is determined that the calculation tape length tp is not smaller than the length (a+x); and cutting the tape to the set tape length t.

According to the tape printing apparatus and method, it is determined whether or not the calculation tape length tp (tp>0) calculated based on the input print data is smaller than the length (a+x) obtained by adding the predetermined length x to the length a between the cutting position at which the tape is cut through and the exit position for discharging the cutoff strip of the tape from the apparatus, and when it is determined that $tp<(a+x)$ holds, the tape length t is changed such that $tp \geqq (a+x)$ holds. Therefore, the tape length t is always set to a length equal to or larger than the length obtained by adding the predetermined length x to the length a between the cutting position and the exit position. In short, even when the calculation tape length tp calculated based on the print data is small, the tape length t is changed such that $t \geqq (a+x)$ holds, so that during cutting operation, the leading end portion of the tape is held in a state exposed at least by the length x, which ensures reliable discharge of a cut-off tape strip from the apparatus.

Preferably, the print data input means is capable of inputting the print data formed of character data to be printed, leading margin data indicative of a length of a leading margin of the tape strip, and trailing margin data indicative of a length of a trailing margin of the tape strip.

According to this preferred embodiment, it is possible to input characters to be printed and the lengths of leading and trailing margins of a tape strip. In other words, not only characters, but also the lengths of leading and trailing margins can be set as a user desires. It should be noted that characters include letters, symbols, figures and decorations.

Alternatively, the print data input means is capable of inputting character data to be printed, and the print data is formed of the character data, and leading margin data and trailing margin data indicative of respective predetermined lengths of leading and trailing margins of the tape strip.

According to this preferred embodiment, it is possible to input characters to be printed, and the lengths of leading and trailing margins are each set to a predetermined length. In short, it is not required to set the lengths of leading and trailing margins, and hence time and labor required for input of print data can be reduced, which makes it possible to simplify the operation.

Preferably, the tape printing apparatus further comprises character position-setting means for setting layout of a character portion to be printed based on the character data, and the predetermined lengths indicated by the leading margin data and the trailing margin data, respectively, are set according to the layout of the character portion set by the character position-setting means.

According to this preferred embodiment, it is possible to set the layout of the character portion as the user desires. Further, in this case, since the lengths of the leading and trailing margins are set based on the set layout of the character portion, it is possible to save time and labor required for setting the margin lengths.

Preferably, the layout of the character portion includes at least one of forward shift, backward shift, and centering.

According to this preferred embodiment, it is possible to select at least one of "forward shift (leading margin<trailing margin)", "backward shift (leading margin>trailing margin)" and "centering (leading margin=trailing margin)" as the layout of the character portion.

Preferably, when the determining means has determined that the calculation tape length tp is smaller than the length (a+x), the tape length-setting means adds a length $\alpha\{\alpha \geqq (a+x-tp)\}$ $(\alpha>0)$ to the length indicated by any one of the leading margin data and the trailing margin data, to thereby set the tape length t such that the tape length t becomes equal to or larger than the length (a+x).

According to this preferred embodiment, when it is determined that $tp<(a+x)$ holds, it is possible to add a length $\alpha\{\alpha \geqq (a+x-tp)\}$ $(\alpha>0)$ to the length of the leading margin or the trailing margin to thereby set the tape length t such that $t \geqq (a+x)$ holds. More specifically, by setting any one of the lengths of the leading margin and the trailing margin to a length increased by the length $\alpha$, it is possible to always set the tape length t to a length larger than the length obtained by adding the predetermined length x to the length a between the cutting position and the exit position, which ensures reliable discharge of the tape strip from the apparatus.

Preferably, the length a is determined by using an equation of $\alpha=a+x-tp$.

According to this preferred embodiment, it is possible to always hold the leading end portion of the tape in a state exposed by the length x from the exit position. In short, it is possible to set a tape end exposure length (x) for reliable discharge of the tape strip from the apparatus.

Preferably, when the determining means has determined that the calculation tape length tp is smaller than the length (a+x), the tape length-setting means adds a length $\beta[\beta>\{(a+x-tp)/2\}]$ $(\beta>0)$ to each of the lengths indicated by the leading margin data and the trailing margin data, to thereby set the tape length t such that the tape length becomes equal to or larger than the length (a+x).

According to this preferred embodiment, when the determining means has determined that $tp<(a+x)$ holds, it is possible to set the tape length t such that $t \geqq (a+x)$ holds by adding a length $\beta[\beta>\{(a+x-tp)/2\}]$ $(\beta>0)$ to each of the lengths indicated by the leading margin data and the trailing margin data. That is, by adding the length $\beta$ to each of the lengths of the leading margin and the trailing margin, the tape length t always becomes larger than the length obtained by adding the predetermined length x to the length a between the cutting position and the exit position. Therefore, it is possible to ensure reliable discharge of the tape strip from the apparatus. Further, since the leading and trailing margin lengths are made uniform, a nice-looking tape strip can be produced.

Preferably, the length $\beta$ is determined by using an equation of $\beta=(a+x-tp)/2$.

According to this preferred embodiment, it is possible to always hold the leading end portion of the tape in a state exposed by the length x from the exit position. In short, it is possible to set a tape end exposure length (x) for reliable discharge of the tape strip from the apparatus.

Preferably, the predetermined length x is a length which enables a human to pinch the tape between his/her fingers.

According to this preferred embodiment, since the tape end exposure length (x) is set to a length which enables a human to pinch the tape between his/her fingers, the user can hold the leading end portion of the tape between his/her fingers during cutting operation. Thus, the tape strip can be drawn out (discharged) from the apparatus more reliably.

To attain the above object, according to a third aspect of the invention, there is provided a tape printing apparatus that is capable of producing a tape strip having a desired tape length by printing on a tape while feeding the tape and then cutting the tape at a trailing end of a printed portion thereof, the tape printing apparatus comprising:

tape feed means for feeding the tape;

printing means for printing on the tape;

print data input means for inputting print data to be printed by the printing means;

tape length-calculating means for calculating a calculation tape length tp $(tp>0)$ based on the print data input via the print data input means;

cutter means for cutting the tape based on the calculation tape length tp calculated by the tape length-calculating means; and determining means for determining whether or not the calculation tape length tp calculated by the tape length-calculating means is smaller than a length (a+x) obtained by adding a predetermined length x $(x \geqq 0)$ to a length a $(a \geqq 0)$ between a cutting position at which the tape is cut through by the cutter means and a position of an exit via which a cut-off strip of the tape is discharged out of the tape printing apparatus, wherein if the determining means has determined that the calculation tape length tp is not smaller than the length (tp+b), the printing means carries out printing while the tape feed means feeds the tape by the length tp, and then the cutter means cuts the tape at a trailing end of the printed portion thereof, and if the determining means has determined that the calculation tape length tp is smaller than the length (a+x), the printing means carries out printing while the tape feed means feeds the tape by the length tp, and then the tape feed means alone operates to further feed the tape by a length $\alpha\{\alpha \geqq (a+x-tp)\}(\alpha>0)$, followed by the cutter means cutting the tape at a trailing end of the printed portion thereof.

To attain the above object, according to a fourth aspect of the invention, there is provided a tape printing method for a tape printing apparatus that is capable of producing a tape strip having a desired tape length by printing on a tape while feeding the tape and then cutting the tape at a trailing end of a printed portion thereof, the tape printing method comprising the steps of:

inputting print data to be printed;

calculating a calculation tape length tp (tp>0) based on the input print data;

determining whether or not the calculation tape length tp is smaller than a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus; and carrying out printing while feeding the tape by the calculation tape length tp, and then cutting the tape at a trailing end of the printed portion thereof if it is determined that the calculation tape length tp is not smaller than the length (tp+b), or carrying out printing while feeding the tape by the length tp, and then further feeding the tape by a length $\alpha\{\alpha \geqq (a+x-tp)\}$ ($\alpha>0$), followed by cutting the tape at a trailing end of the printed portion thereof if it is determined that the calculation tape length tp is smaller than the length (a+x).

According to the tape printing apparatus and method, it is determined whether or not the calculation tape length tp is smaller than the length (a+x) obtained by adding the predetermined length x to the length a between the cutting position and the exit position, and if it is determined that $tp \geqq (tp+b)$ holds, printing is carried out simultaneously with tape feed by the length tp, and then the tape is cut at a trailing end of the printed portion thereof, whereas if it is determined that $tp<(a+x)$ holds, printing is carried out simultaneously with tape feed by the length tp, and then the tape is further fed by a length $\alpha\{\alpha \geqq (a+x-tp)\}$ ($\alpha>0$), followed by being cut at a trailing end of the printed portion thereof. In short, in both cases, a total tape feed length becomes equal to or larger than the length (a+x), which means that the tape is always fed by a length equal to or larger than the length obtained by adding the predetermined length x to the length a between the cutting position and the exit position. Therefore, even when the calculation tape length tp calculated based on the print data is short, the tape is fed by the length $\alpha\{\alpha \geqq (a+x-tp)\}$, so that during cutting operation, the leading end portion of the tape is held in a state exposed at least by the length x, which ensures reliable discharge of a cut-off tape strip from the apparatus.

Preferably, when the determining means has determined that the calculation tape length tp is smaller than the length (a+x), the tape feed means feeds the tape by the length tp, and then the printing means prints a cut mark on the tape.

According to this preferred embodiment, when it is determined that $tp<(a+x)$ holds, the tape is fed by the length tp, and then the cut mark is printed on the tape, so that the trailing end portion of the printed portion of the tape can be cut off along the cut mark, which makes it possible to produce a nice-looking tape strip. More specifically, when it is determined that $tp<(a+x)$ holds, the trailing end portion of the printed portion includes an unwanted portion (i.e. a portion other than the portion corresponding to the calculation tape length tp) having a length $\{(a+x)-tp\}$, but since the cut mark is printed at the leading end of the unwanted portion, it is possible to cut off the unwanted portion accurately. Further, if cut marks are printed in straight line along a cutting line when a tape with a large width is employed, it is possible to form a tape strip having a straight and nice-looking trailing edge.

Preferably, the length a is determined by using an equation of $\alpha=a+x-tp$.

According to this preferred embodiment, it is possible to always cut the tape with the leading end portion thereof exposed by the length x from the exit position. In other words, it is possible to set the tape end exposure length (x) for reliable discharge of the tape strip from the apparatus.

Preferably, the predetermined length x is a length which enables a human to pinch the tape between his/her fingers.

According to this preferred embodiment, since the tape end exposure length (x) is set to a length which enables a human to pinch the tape between his/her fingers, the user can hold the leading end portion of the tape between his/her fingers during cutting operation. Thus, the tape strip can be drawn out (discharged) from the apparatus more reliably.

To attain the above object, according to a fifth aspect of the invention, there is provided a tape printing apparatus that is capable of producing a tape strip having a desired tape length by printing on a tape while feeding the tape and then cutting the tape at a trailing end of a printed portion thereof at a location downstream of a location where printing is carried out, the tape printing apparatus comprising:

tape feed means for feeding the tape;

printing means for printing on the tape;

print data input means for inputting print data to be printed by the printing means;

tape length-calculating means for calculating a calculation tape length tp (tp>0) based on the print data input via the print data input means;

cutter means for cutting the tape based on the calculation tape length tp set by the tape length-setting means; and determining means for determining whether or not a length (a+x) obtained by adding a predetermined length x ($x \geqq 0$) to a length a ($a \geqq 0$) between a cutting position at which the tape is cut through by the cutter means and a position of an exit via which a cut-off strip of the tape is discharged out of the tape printing apparatus is larger than a length (tp+b) obtained by adding a length b ($b \geqq 0$) between a printing position at which printing is carried out by the printing means and the cutting position to the calculation tape length tp, wherein if the determining means has determined that the length (a+x) is not larger than the length (tp+b), the printing means carries out the printing while the tape feed means feeds the tape by the length (tp+b), and then the cutter means cuts the tape at a trailing end of the printed portion thereof, and if the determining means has determined that length (a+x) is larger than the length (tp+b), the printing means carries out the printing while the tape feed means feeds the tape by the length (tp+b), and then the tape feed means alone operates to further feed the tape by a length $\gamma\{\gamma \geqq (a+x)-(tp+b)\}$ ($\gamma>0$), followed by the cutter means cutting the tape at a trailing end of the printed portion thereof.

Further, to attain the above object, according to a sixth aspect of the invention, there is provided a tape printing method for a tape printing apparatus that is capable of producing a tape strip having a desired tape length by printing on a tape while feeding the tape and then cutting the tape at a trailing end of a printed portion thereof at a location downstream of a location where printing is performed, the tape printing method comprising the steps of:

inputting print data to be printed;

calculating a calculation tape length tp ($tp>0$) based on the input print data;

determining whether or not a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus is larger than a length (tp+b) obtained by adding a length b ($b \geqq 0$) between a printing position at which printing is carried out and the cutting position to the calculation tape length tp; and carrying out printing while feeding the tape by the length (tp+b), and then cutting the tape at a trailing end of the printed portion thereof if it is determined that the length (a+x) is not larger than the length (tp+b), or carrying out printing while feeding the tape by the length (tp+b), and then further feeding the tape by a length $\gamma\{\gamma \geqq (a+x)-(tp+b)\}$ ($\gamma>0$), followed by cutting the tape at a trailing end of the printed portion thereof, if it is determined that the length (a+x) is larger than the length (tp+b).

According to the tape printing apparatus and method, it is determined whether or not the length (a+x) obtained by adding the predetermined length x to the length a between the cutting position and the exit position is larger than the length (tp+b) obtained by adding the length b between the printing position and the cutting position to the calculation tape length tp, and if it is determined that $(a+x) \leqq (tp+b)$ holds, printing is carried out while feeding the tape by the length (tp+b), and then the tape is cut at the trailing end of the printed portion thereof, whereas if it is determined that $(a+x)>(tp+b)$ holds, printing is carried out while feeding the tape by the length (tp+b), and then the tape is further fed by the length $\gamma\{\gamma \geqq (a+x)-(tp+b)\}$, followed by being cut at the trailing end of the printed portion thereof. In short, in both cases, a total tape feed length becomes equal to or larger than the length (a+x), which means that the tape is always fed by a length equal to or larger than the length obtained by adding the predetermined length x to the length a between the cutting position and the exit position. Therefore, even when the calculation tape length tp calculated based on the print data is short, the tape is fed by the length $\gamma\{\gamma \geqq (a+x)-(tp+b)\}$ after printing, so that during cutting operation, the leading end portion of the tape is held in a state exposed at least by the length x, which ensures reliable discharge of a cut-off tape strip from the apparatus.

Preferably, the print data is formed of character data to be printed, leading margin data indicative of a length of a leading margin of the tape strip, and trailing margin data indicative of a length of a trailing margin of the tape strip, the tape printing apparatus further comprising second determining means for determining whether or not a length t1 ($t1 \geqq 0$) indicated by the leading margin data is smaller than the length b ($b \geqq 0$) between the printing position and the cutting position, and if the second determining means has determined that the length t1 is smaller than the length b, the printing means prints a cut mark on the tape before the tape is fed by the tape feed means.

According to this preferred embodiment, the print data is formed of character data to be printed, leading margin data indicative of a length of a leading margin of the tape strip, and trailing margin data indicative of a length of a trailing margin of the tape strip, and it is determined whether or not a length t1 ($t1 \geqq 0$) indicated by the leading margin data is smaller than the length b ($b \geqq 0$) between the printing position and the cutting position. Then, if it is determined that $t1<b$ holds, the cut mark is printed on the tape before the tape feed by the tape feed means, so that the leading end portion of the printed portion of the tape can be cut off along the cut mark, which makes it possible to produce a nice-looking tape strip. More specifically, when printing is performed at a location upstream of the cutting position, and the length t1 indicated by the leading margin data is smaller than the length b between the printing position and the cutting position, the leading end portion of the printed portion includes an unwanted portion (i.e. a portion other than the portion corresponding to the calculation tape length tp) having a length b, but since the cut mark is printed at the trailing end of the unwanted portion, it is possible to cut off the unwanted portion accurately. Further, if cut marks are printed in straight line along a cutting line when a tape with a large width is employed, it is possible to form a tape strip having a straight and nice-looking leading edge.

Preferably, if the determining means has determined that the length (a+x) is larger than the length (tp+b), the tape feed means feeds the tape by the length (tp+b), and then the printing means prints a cut mark on the tape.

According to this preferred embodiment, when it is determined that $(a+x)>(tp+b)$ holds, the tape is fed by the length (tp+b), and then the cut mark is printed on the tape, so that the trailing end portion of the printed portion of the tape can be cut off along the cut mark, which makes it possible to produce a nice-looking tape strip. More specifically, when $(a+x)>(tp+b)$ holds, the trailing end portion of the printed portion includes an unwanted portion (i.e. a portion other than the portion corresponding to the calculation tape length tp) having a length $\{(a+x)-(tp+b)\}$, but since the cut mark is printed at the leading end of the unwanted portion, it is possible to cut off the unwanted portion accurately. Further, if cut marks are printed in straight line along a cutting line when a tape with a large width is employed, it is possible to form a tape strip having a straight and nice-looking trailing edge.

Preferably, the length $\gamma$ is obtained by an equation of $\gamma=(a+x)-(tp+b)$.

According to this preferred embodiment, it is possible to always cut the tape with the leading end portion thereof exposed by the length x from the exit position. In other words, it is possible to set the tape end exposure length (x) for reliable discharge of the tape strip from the apparatus.

Preferably, the predetermined length x is a length which enables a human to pinch the tape between his/her fingers.

According to this preferred embodiment, since the tape end exposure length (x) is set to a length which enables a human to pinch the tape between his/her fingers, the user can hold the leading end portion of the tape between his/her fingers during cutting operation. Thus, the tape strip can be drawn out (discharged) from the apparatus more reliably.

In the tape printing apparatus according to any of the first, third, and fifth aspects of the invention, it is preferred that the cutter means comprises a cutter blade and a retaining portion for retaining the cutter blade, the tape fed between the cutter blade and the retaining portion being cut by force-cutting through actuation of the cutter blade, and the tape printing apparatus further comprises tape-retaining means arranged between the cutting position at which the tape is cut through and the position of the exit via which the cut-off strip of the tape is discharged out of the tape printing apparatus, for retaining the tape to prevent the tape from being displaced by cutting operation of the cutter blade.

According to this preferred embodiment, since the tape-retaining means is provided, it is possible to prevent displacement of the tape which can be caused by a pressing force generated by cutting operation when the tape is cut by force-cutting or in a pushing manner, to thereby cut the tape stably. Further, even when the present tape printing apparatus is a handy type and used during electric work or the like at a high place, since the tape is held or retained in a sandwiched manner for cutting operation, it is possible to prevent the tape strip from falling.

Preferably, the tape-retaining means retains the tape portion prior to the cutting operation in which the cutter blade is brought into contact with the retaining portion, and after completion of the cutting operation of the cutter blade, releases the tape subsequent to a return motion of the cutter blade moving away from the retaining portion.

According to this preferred embodiment, since the tape is retained or sandwiched before cutting operation, it is possible to cut the tape more stably. Further, since the tape-retaining means releases the tape from the sandwiched state by following the return motion of the cutter blade moving away from the retaining portion after completion of the cutting operation of the cutter blade, the user can hold the portion of the tape exposed from the apparatus, between his/her fingers during the cutting operation, and draw out the cut-off tape strip positively after completion of the cutting operation.

In the tape printing apparatus according to any of the first, third, and fifth aspects of the invention, it is preferred that the tape is contained in a cartridge in a state wound into a roll, and the tape printing apparatus includes a cartridge compartment in which the cartridge is accommodated.

According to this preferred embodiment, since the tape is contained in the cartridge in the state wound into a roll, it is possible to make the apparatus compact in size.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to the drawings showing embodiments of a tape printing apparatus and method according to the invention. The tape printing apparatus of the invention is capable of carrying out printing of letters, symbols, figures, decorations, and so forth on a tape based on print data input by a user, while feeding the tape unwound from a tape cartridge removably loaded in the apparatus, and then cutting the printed portion of the tape to a tape length calculated based on the print data, to thereby produce a label.

Further, when it is determined that the calculation tape length tp ($tp>0$) calculated for the cutting operation is equal to or smaller than a minimum tape length $t\mathbf{0}$ ($t\mathbf{0}>0$: a length ($a+x$) obtained by adding a predetermined length x ($x\geqq 0$) to a length a ($a\geqq 0$) between a cutting position 16*a* at which the tape is cut through and an exit position 15*a* from which a cut-off strip of the tape is discharged out of the apparatus), the tape printing apparatus performs control for changing setting of a tape length t of a tape strip (label) to be produced or controls operations of a tape feed mechanism, to thereby enable reliable discharge of the tape strip (label). It should be noted that alphabet letters representative of respective lengths used in the following description are defined as follows:

t: tape length ($t>0$)(of a tape strip to be produced)

tp: calculation tape length ($tp>0$) calculated based on print data $t\mathbf{0}$: minimum tape length $t\mathbf{0}=a+x$ ($t\mathbf{0}>0$)

t1: leading margin length ($t1\geqq 0$)

a: length between cutting position and exit position ($a\geqq 0$)

b: length between printing position and cutting position ($b\geqq 0$)

x: tape end exposure length ($x\geqq 0$) from exit position

Figure 1:
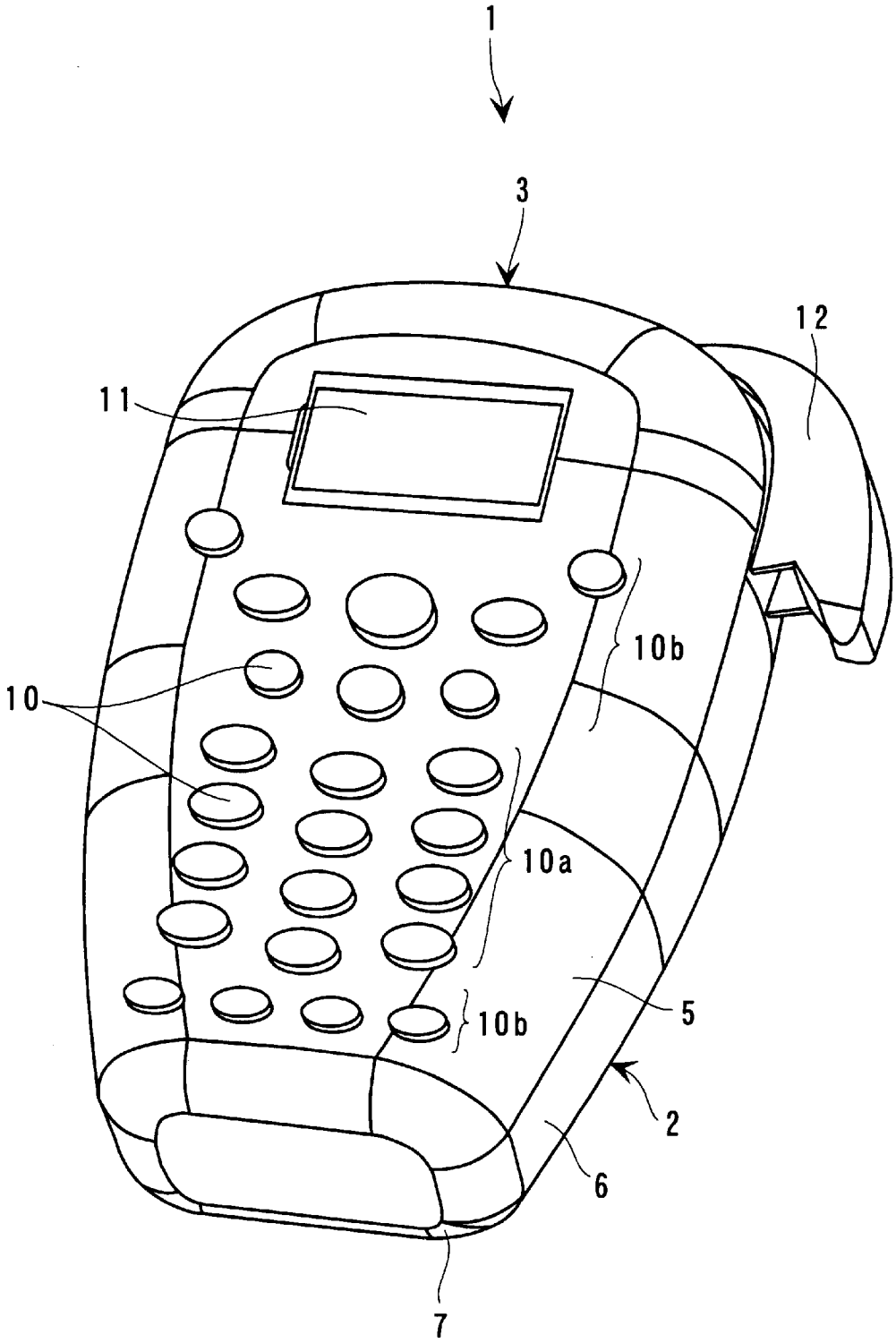
FIG. 1 is a perspective view of the whole appearance of a tape printing apparatus according to the invention.
Figure 2:
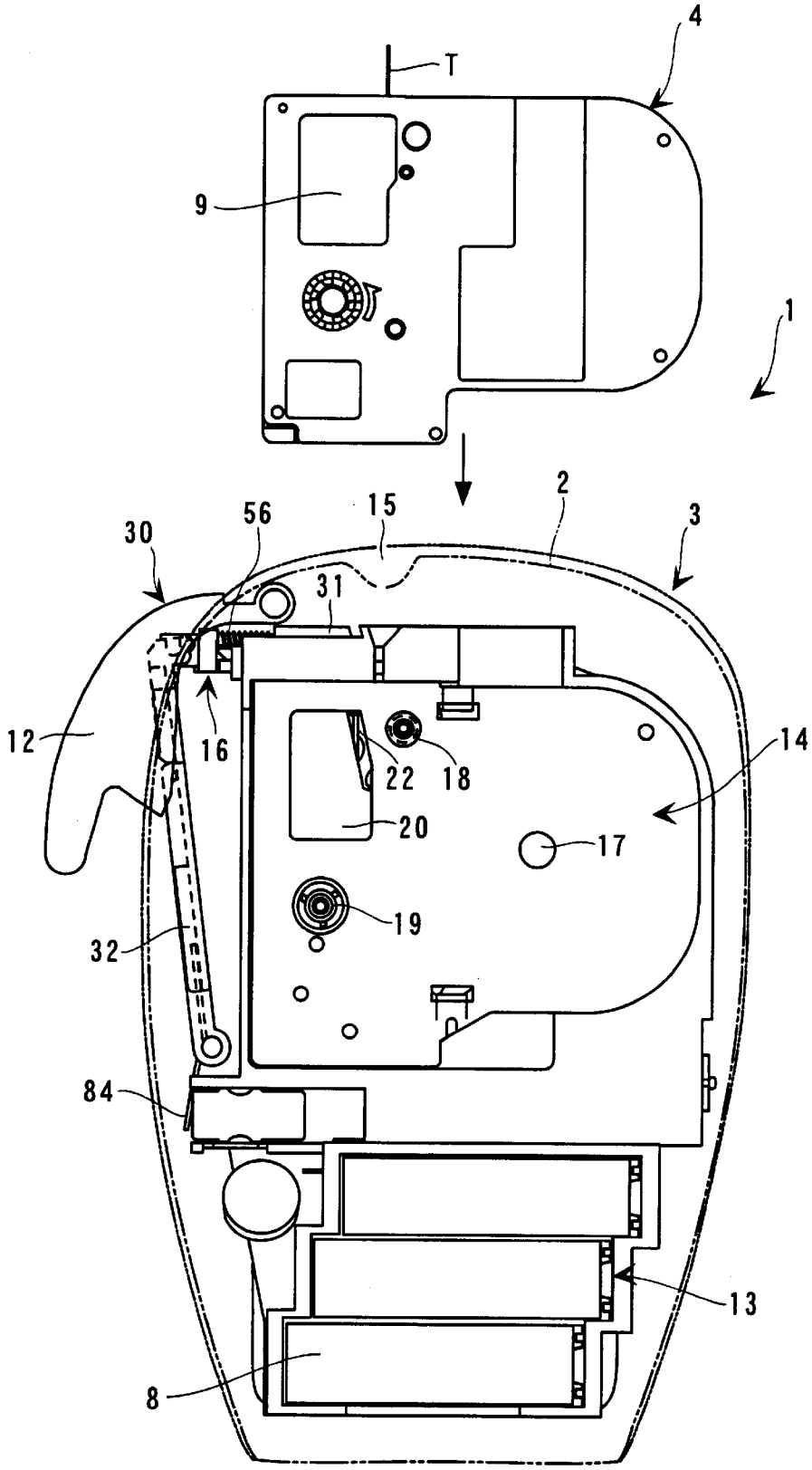
FIG. 2 is a bottom view of the whole of the FIG. 1 tape printing apparatus with an apparatus casing thereof removed.
Figure 3:
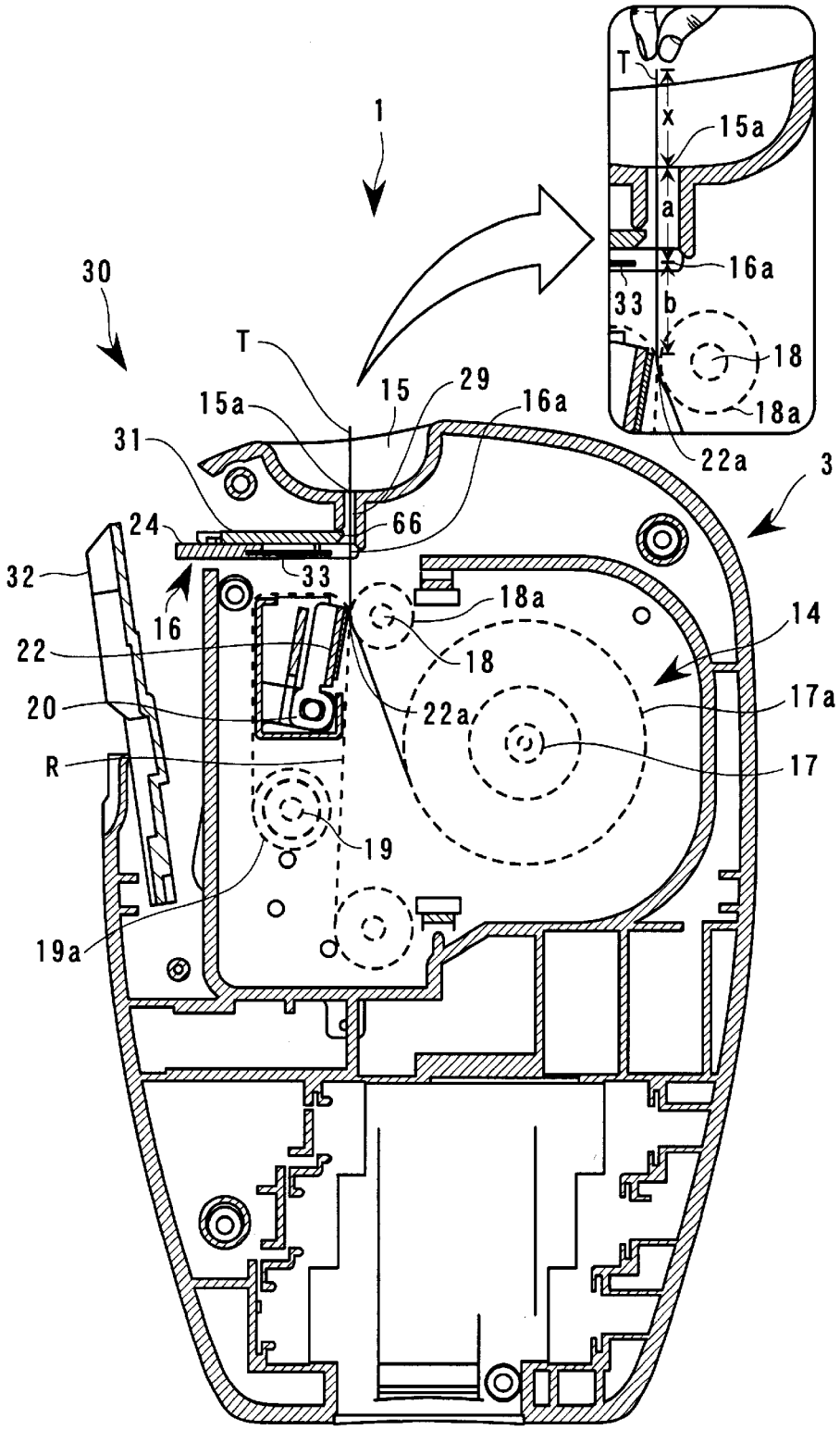
FIG. 3 is a cross-sectional view of the whole of the FIG. 1 tape printing apparatus.

First, the arrangement of the tape printing apparatus 1 will be described with reference to FIGS. 1 to 3. FIG. 1 is a perspective view of the whole appearance of the tape printing apparatus 1, while FIG. 2 is a bottom view of the whole of the same with its apparatus casing removed. Further, FIG. 3 shows the apparatus 1 in full cross-section. As shown in the figures, the tape printing apparatus 1 is comprised of a main unit 3 having the apparatus casing 2 forming an outer shell thereof, and the tape cartridge 4 removably mounted in the main unit 3. The tape cartridge 4 contains a tape T with a peel-off paper, on which printing is effected, such that the tape T can be rolled out from the tape cartridge 4.

The apparatus casing 2 is formed to have a generally oval shape in plan view, and comprised of an upper casing 5 forming a top surface thereof, a middle casing 6 welded to the upper casing 5 to form a side surface thereof, and a lower casing 7 forming a bottom surface thereof. The lower casing 7 which is removable from the middle casing 6 also serves as a lid for holding the tape cartridge 4 and a battery 8 mounted in the apparatus casing 2 from below.

The main unit 3 has a keyboard 10 comprised of a plurality of keys arranged as input means in a large area on the top surface of the apparatus casing 2, and a display 11 arranged at the rear of the keyboard 10, for displaying information of letters and the like for printing.

On the keyboard 10, there are arranged a character key group 10*a* including an alphabet key group, a symbol key group, a number key group, and a nonstandard character key group for calling nonstandard characters for selection, as well as a function key group 10*b* for designating various operation modes. In a type of the apparatus which is capable of inputting the Japanese language, the character key group 10*a* also includes a kana key group for inputting Japanese hiragana letters and Japanese katakana letters. The function key group 10*b* includes a power key, a print key for instructing the apparatus 1 to perform a printing operation, a selection key for finally determining the input of character data and starting a new line during text input as well as determining selection of one of modes or options on a selection screen, a margin length-setting key for setting a leading margin length and a trailing margin length, cursor keys for moving the cursor or the display range of print image data on the display 11 in respective leftward and rightward directions, and a cancel key for canceling various instructions.

To the right-side rear portion of the apparatus casing 2 is attached a manually-operated lever 12 projecting outward from the apparatus casing 2 and extending frontward along the right-side surface of the same. Further, within the lower casing 7 of the main unit 3, there are formed front, intermediate, and rear battery-receiving blocks 13 for receiving six batteries 8 in total such that the blocks 13 each containing two batteries are arranged in a staggered manner, and a cartridge compartment 14 at a rear-side location, for removably receiving the tape cartridge 4 therein.

Further, the apparatus casing 2 has a tape exit 15 in the form of a slit formed in an intermediate portion of a rear-side wall thereof in a manner extending vertically, for sending a printed portion of the tape T out of the apparatus (exit position 15*a*). The tape exit 15 communicates with the cartridge compartment 14, and a cutter 16 is arranged between the tape exit 15 and the cartridge compartment 14 to face the tape exit 15 (cutting position 16*a*). When the manually-operated lever 12 is operated, the cutter 16 is caused to perform a cutting operation for cutting a portion of the tape T dispensed through the tape exit 15 to a desired length to thereby produce a label. The manually-operated lever 12, the cutter 16, and a tape-retaining member 31 and a pivot arm 32, each referred to hereinafter, form a tape-cutting mechanism 30.

The main unit 3 constructed as above is formed to have a predetermined thickness as a whole, and small enough to carry easily with one hand. When the apparatus 1 is in actual use, the user holds the main unit 3 in both hands and operates keys of the keyboard 10 by using the thumbs or other fingers of his/her hands to input desired letters or the like. Further, when it is required to cut off a printed portion of the tape T after completion of printing, the manually-operated lever 12 of the main unit 3 held in the hands is pivotally moved inward toward the user by his/her right index or middle finger.

As shown in FIGS. 2 and 3, the cartridge compartment 14 has a central portion thereof on which are erected a guide projection 17 for guiding the tape cartridge 4 into the cartridge compartment 14 so as to mount the same therein, a platen drive shaft 18 for giving a rotational force to driven portions of the tape cartridge 4, a ribbon take-up shaft 19 and a head unit 20 including a print head 22 opposed to the platen drive shaft 18. A base frame 21 is arranged in a space above the cartridge compartment 14, for supporting a tape feed mechanism, not shown, including a motor which causes rotation of the platen drive shaft 18 and the ribbon take-up shaft 19, and the cutter 16 and the tape-retaining member 31 are also supported by the base frame 21 in a slidable manner (which will be described in detail hereinafter).

The tape cartridge 4 contains not only the tape T wound around a tape reel 17*a*, but also an ink ribbon R to be fed, similarly to the tape T, in a longitudinal direction thereof with its width positioned vertically, and a platen 18*a* for engagement with the platen drive shaft 18. Further, formed in the vicinity of the platen 18*a* is a head opening 9 to which the print head 22 of the main unit 3 is brought. The ink ribbon R meets the tape T at a location (printing position 22*a*) where the platen 18*a* (print head 22) is arranged, and fed or run together with the tape T in a state lying upon the tape T, followed by being taken up by the ribbon take-up reel 19*a* with which the ribbon take-up shaft 19 is engaged. On the other hand, the tape T passes through a slit opening formed in a side portion of the casing of the tape cartridge 4, and is sent out via the tape exit 15. It should be noted that tape cartridges 4 are provided which contain four kinds of tapes T having respective tape widths of 6 mm, 9 mm, 12 mm and 18 mm.

To use the tape printing apparatus 1, first, the user turns the main unit 3 upside down and removes the lower casing 7, and then mounts the tape cartridge 4 in the cartridge compartment 14. When the tape cartridge 4 is mounted in the cartridge compartment 14, the leading end portion of the tape T and the ink ribbon R are inserted between the platen 18*a* and the print head 22, and the platen 18*a* and the ribbon take-up reel 19*a* are brought into engagement with the platen drive shaft 18 and the ribbon take-up shaft 19, respectively. Then, when the lower casing 7 is mounted to the middle casing 6, the print head 22 pivotally moves and abuts on the platen 18*a* to sandwich the tape T and the ink ribbon R between the platen 18*a* and the print head 22 itself, and the apparatus 1 is placed in a printing wait state.

Then, the user turns over the main unit 3 to its normal position, and prepares for input while holding the main unit 3 with both hands. When the preparation is made, the user pushes the power key to turn on the apparatus 1, and then enters information of the type of the tape cartridge 4 by operating the keyboard 10 while viewing the display 11. After the type of the tape cartridge 4 is recognized, the user operates the keyboard 10 to input/edit desired characters and issue an instruction for printing.

When the instruction for printing is issued, the tape T and the ink ribbon R are fed simultaneously, and the print head 22 is driven for printing as required, whereby ink of the ink ribbon R is thermally transferred onto the tape T. The portion of the ink ribbon R used for printing is taken up within the tape cartridge 4, whereas the printed portion of the tape T is sent out via the tape exit 15 (exit position 15*a*). The printed portion of the tape T is cut off when the manually-operated lever 12 is operated by the user after feeding of the tape T is stopped. As described in detail hereinbelow, in an actual operation for cutting the tape T, the tape-retaining member 31 slides to the stopper portion to sandwich the tape T between the stopper portion and the tape-retaining member 31 itself, and then the printed portion of the tape T is cut off by the cutter 16 which has slid after the tape-retaining member 31.

Now, the tape-cutting mechanism 30 will be described with reference to FIG. 3. As shown in the figure, the tape-cutting mechanism 30 is comprised of the cutter 16 with a cutter blade 33 (oblique blade), which can slide in a left-right direction as viewed in the figure to and from a position opposed to the tape exit 15, the tape-retaining member 31 positioned immediately behind the cutter 16 and slidable together with the same, the manually-operated lever 12 (see FIG. 2) for causing the cutter 16 to perform cutting operation, and the pivot arm 32 interposed between the manually-operated lever 12 and the cutter 16. In the tape-cutting mechanism 30, the pivot arm 32 is pivoted by operation of the manually-operated lever 12, and the pivotal motion of the pivot arm 32 causes the cutter 16 and the tape-retaining member 31 to slide, whereby the tape T is cut through by force-cutting by the cutter 16 in a state held by the tape-retaining member 31.

Next, brief description will be given of the cutting operation performed by the cutter 16 and the tape-retaining member 31 for cutting off the printed portion of the tape T. When a pressing force is transmitted from the manually-operated lever 12 to the tape-cutting mechanism 30 via the pivot arm 32, the tape-retaining member 31 starts sliding forward (rightward as viewed in FIG. 3) together with the cutter 16. The tape-retaining member 31 has a tape-retaining face portion 66 slightly protruding beyond the forward end of the cutter blade 33 in a direction of sliding of the tape-retaining member 31 (i.e. a direction of cutting of the cutter 16), and hence, when the cutter 16 and the tape-retaining member 31 slide forward, the tape-retaining member 31 advances ahead of the cutter 16 and comes into abutment against the stopper portion to press the tape T against the same. As a result, the motion of the tape-retaining member 31 is stopped, but the cutter 16 cuts into the tape T while compressing a spring 56 (see FIG. 2).

The cutter blade (oblique blade) 33 progressively cuts into the tape T by force cutting vertically downwardly in the direction of width of the tape T to cut off the printed portion of the tape T. During the cutting operation by the cutter blade 33, the tape T is pressed firmly against the stopper portion at a location downstream in the feeding direction by the tape-retaining member 31 urged by the compressed spring 56, so that it is possible to cut the tape T stably. When the edge of the cutter blade 33 advances beyond the location of a passage slit 29 to cut off the printed portion of the tape T completely, the manually-operated lever 12 is brought into a stopped state, whereby further cutting is inhibited.

When the user returns the manually-operated lever 12 from this state, the cutter 16 shifts to a return operation prior to the tape-retaining member 31, and slides to a predetermined cutter return end position. Then, the cutter 16 further slides backward (leftward as viewed in FIG. 3) together with the tape-retaining member 31 by being driven by a rotational force of a coiled spring 84 attached to the base portion of the pivot arm 32, until a pair of guide pieces formed, respectively, on the top and bottom of the tape-retaining member 31 reach the ends of a pair of guide grooves formed in a cutter support frame 24 to stop the backward sliding of the cutter 16. The instant at which the tape-retaining member 31 leaves the tape T, the cut-off tape strip T (label) falls from the tape exit 15 due to its own weight. If the tape length t of the produced tape strip T is short (i.e. when the length of the portion of the tape T exposed from the exit position 15*a* is short), it is preferred that the tape T is cut with its leading end held between the user's fingers. This method enables reliable discharge of the tape strip T from the apparatus 1.

It should be noted that the tape printing apparatus 1 is capable of executing various control processes to reliably expose the leading end portion of the tape T by a predetermined length x from the apparatus via the exit position 15*a*. More specifically, the predetermined length x is a value indicative of a tape end exposure length, i.e. a length of the leading end portion of a tape to be exposed from the exit position 15*a* during cutting operation, so that as shown in FIG. 3, the predetermined length x is assumed as a length (e.g. 9 mm) of a pinching margin which enables a human to pinch the tape T between his/her fingers. Thus, the user can hold the leading end portion of the tape T between his/her fingers for the cutting operation.

Further, as described in detail hereinafter, a length "a" between the exit position 15*a* and the cutting position 16*a* at which a printed portion of the tape T is cut off by the cutter 16 and a length "b" between the cutting position 16*a* and the printing position 22*a* where the print head 22 is brought into abutment with the platen 18*a* are set as illustrated in FIG. 3.

Figure 4:
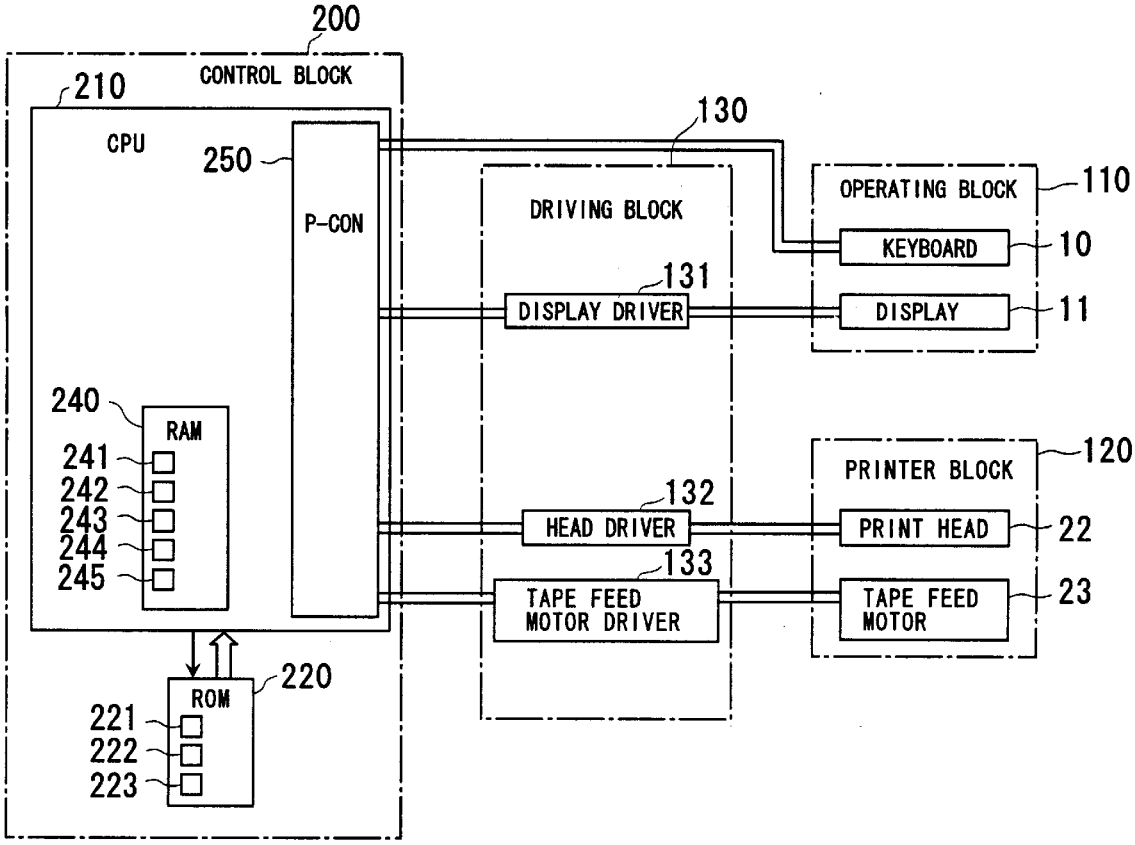
FIG. 4 is a block diagram of a control system of the FIG. 1 tape printing apparatus.

Next, description will be given of a control system of the tape printing apparatus 1. As shown in FIG. 4, the tape printing apparatus 1 is basically comprised of an operating block 110 having the keyboard 10 and the display 11 for interfacing with the user, a printer block 120 having the print head 22 and a tape feed motor 23, for printing on the tape T unwound from the tape cartridge 4, a driving block 130 having a display driver 131, a head driver 132, a tape feed motor driver 133, and other drivers for driving circuits of devices of the apparatus 1, and a control block 200 for controlling operations of blocks and devices of the apparatus 1 including the above-mentioned drivers.

The control block 200 includes a CPU 210 incorporating a RAM 240 and a peripheral control circuit (P-CON) 250, and a ROM 220, both of which are internally connected to each other. The ROM 220 has not only a control program area 221 storing control programs executed by the CPU 210, but also a control data area 222 storing control data including a color conversion table, a character modification table, and the like, and a character generator ROM (CG-ROM) area 223 storing font data, i.e. data defining characters, symbols, figures and the like, provided for the tape printing apparatus 1. When code data specifying a character or the like is input to the CG-ROM area 223, it outputs the corresponding font data.

The RAM 240 is supplied with power by a backup circuit, not shown, such that stored data items can be preserved even when the power is turned off. The RAM 240 includes areas of a register group 241, a text data area 242 for storing text data of characters or the like input by the user via the keyboard 10, a display image data area 243 for storing image data displayed on the display 11, a print image data area 244 for storing print image data, and buffer areas 245 including a print buffer and a color conversion buffer. The RAM 240 is used as a work area for carrying out control operations.

The P-CON 250 incorporates a logic circuit for handling interface signals for interfacing between the CPU 210 and peripheral circuits. The P-CON 250 is connected to the keyboard 10, for receiving commands and data input via the keyboard 10, directly or after processing them, and outputs data and control signals to the driving block 130 directly or after processing them.

The CPU 210 receives commands, data, and the like via the P-CON 250 according to the control program read from the ROM 220, various data stored in the RAM 240, and so forth, and delivers control signals to the driving block 130 via the P-CON 250 to thereby control the operations of the tape feed motor 23 and the display 11, as well as to control the print head 22 to perform printing on the tape A under predetermined printing conditions. In short, the CPU 210 controls the overall operation of the tape printing apparatus 1.

Next, the tape printing method of the invention will be described with reference to FIGS. 5 to 13. According to the invention, as described hereinbefore, the calculation tape length tp (tp>0) is calculated based on print data input by the user, and then it is determined whether or not the calculation tape length tp is smaller than the minimum tape length t0 (t0>0) (length (a+x) obtained by adding the predetermined length x (x≧0) to the length a (a≧0) between the cutting position 16*a* at which the tape T is cut through and the exit position 15*a* from which a cut-off strip of the tape T is discharged out of the apparatus). If it is determined that tp<t0 holds, it is possible to cause the leading end portion of the tape strip T (label) to be reliably exposed by the predetermined length x from the apparatus 1 by carrying out "(1) control for changing setting of the tape length t of a tape strip (label) to be produced" or "(2) control of operation of the tape feed mechanism".

First, as a first embodiment of the invention, "(1) control for changing setting of the tape length t of a tape strip (label) to be produced" will be described with reference to FIGS. 5 to 9D. In this control process, it is determined whether or not the calculation tape length tp smaller than the minimum tape length t0 (t0>0) (length (a+x) obtained by adding the predetermined length x (x≧0) to the length a (a≧0) between the cutting position 16*a* and the exit position 15*a*), and if it is determined that tp<t0 holds, the setting of the tape length t is changed such that t≧t0 holds (i.e. t≧(a+x) holds) (the minimum tape length t0 is hereinafter represented by (a+x)).

Figure 6:
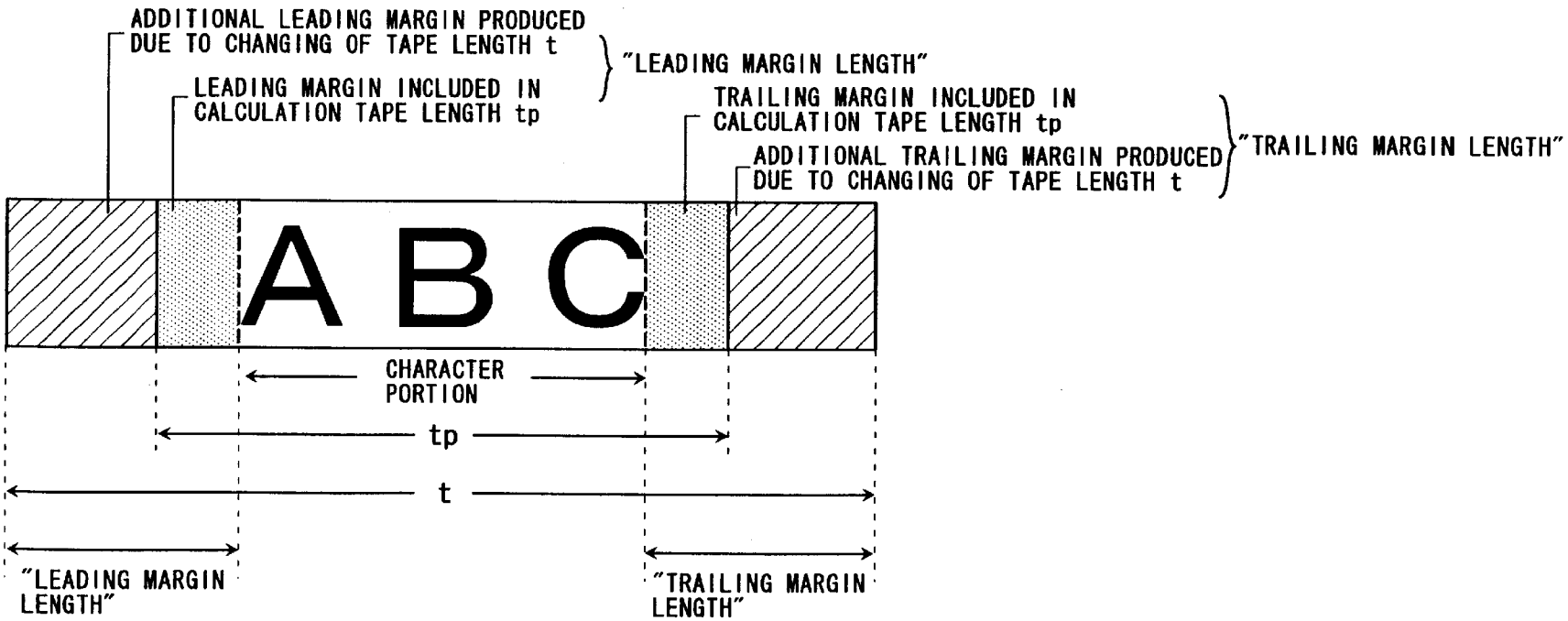
FIG. 6 is a conceptual view useful in explaining a leading margin length and a trailing margin length according to the first embodiment.
Figures 7A, 7B, 7C:
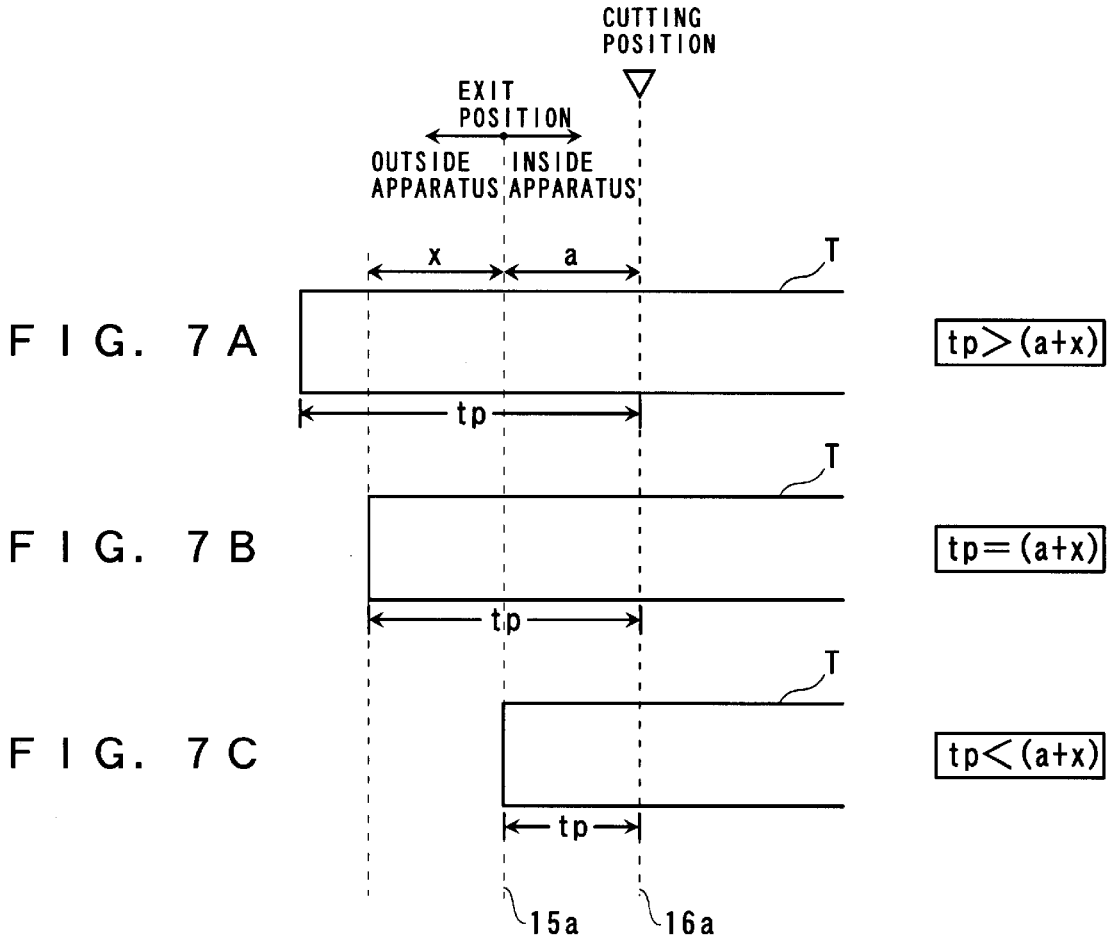
FIGS. 7A to 7C are views each of which is useful in explaining the relationship between a tape length and a length between a cutting position and an exit position.
Figures 8A, 8B, 8C:
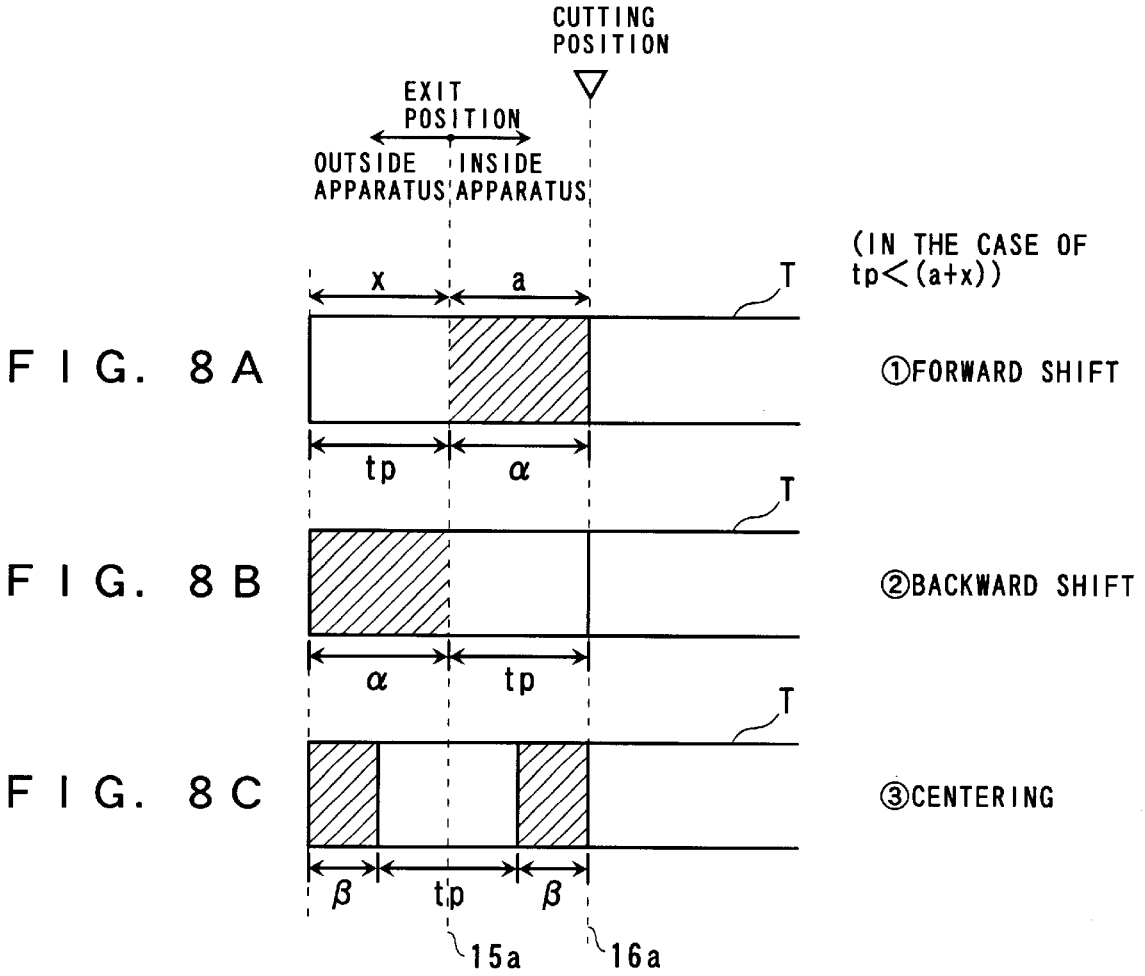
FIGS. 8A to 8C are views useful in explaining three patterns of layout.
Figures 9A, 9B, 9C, 9D:
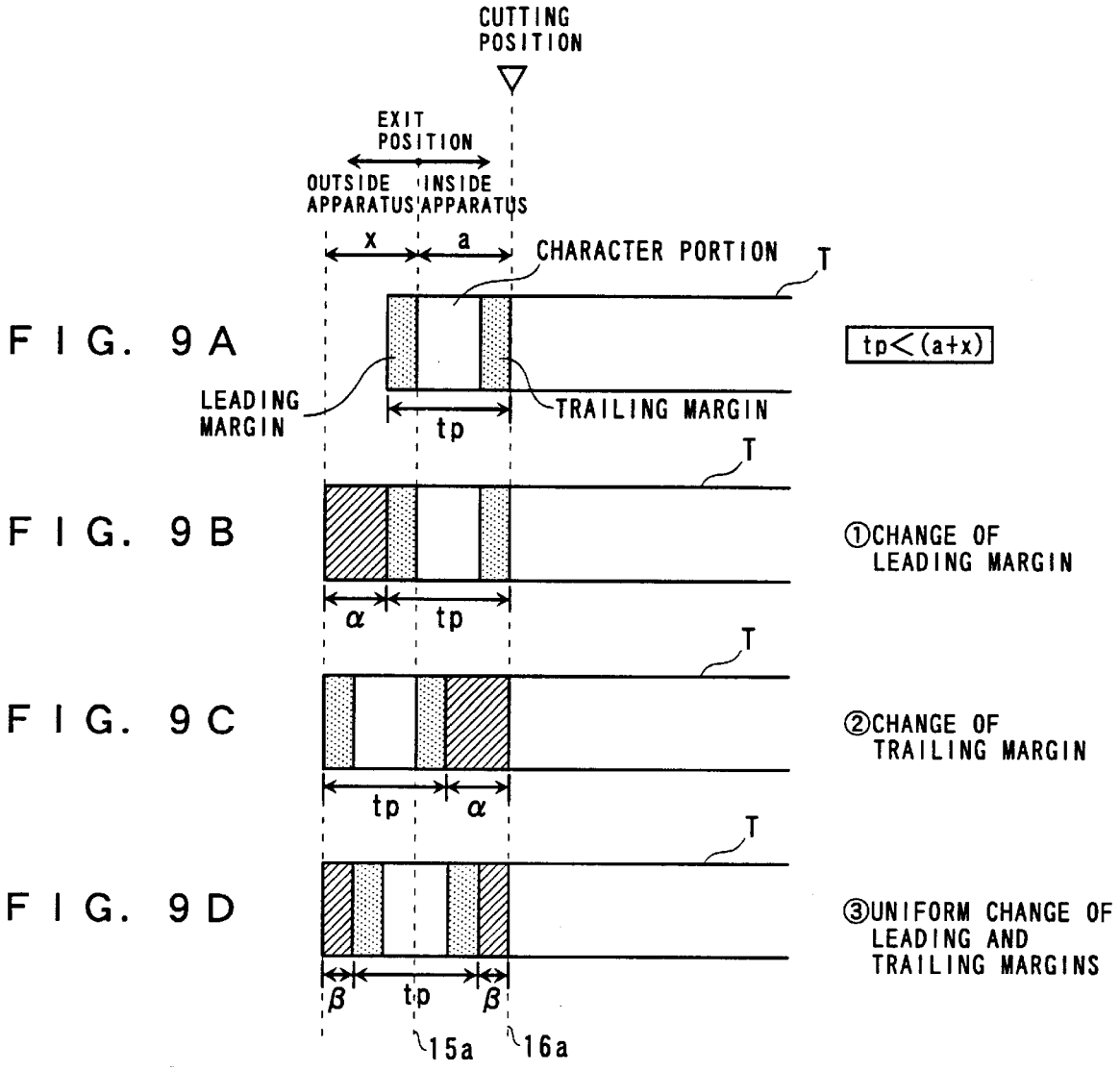
FIGS. 9A to 9D are views useful in explaining three patterns of margin changes.

As shown in FIG. 6, the tape length t is changed by changing the "leading margin length" and/or "trailing margin length" of the tape strip T. The "leading margin length" represents a length obtained by adding together a leading margin included in the calculation tape length tp (i.e. a leading margin determined by layout setting or numerical input, which will be described in detail hereinafter) and an additional leading margin produced due to changing of the calculation tape length tp. In short, the "leading margin length" means a length from the leading edge of the tape strip T to that of a character portion. Similarly, the "trailing margin length" represents a length obtained by adding together a trailing margin included in the calculation tape length tp and an additional trailing margin produced due to changing of the calculation tape length tp, i.e. a length from the trailing edge of a character portion to that of the tape strip T.

The predetermined length x is a value indicative of the exposure length (pinching margin length) of the leading end portion of the tape T to be exposed from the exit position 15*a* before cutting operation, as described hereinabove, so that the predetermined length x is assumed as a length which enables a human to pinch the tape T between his/her fingers. Thus, since the leading end portion of the tape strip T (label) is exposed from the apparatus 1 by the predetermined length x, the user can hold the leading end portion of the tape strip T between his/her fingers during the cutting operation. In short, more reliable discharge of the tape strip T from the apparatus 1 is ensured.

Figure 5:
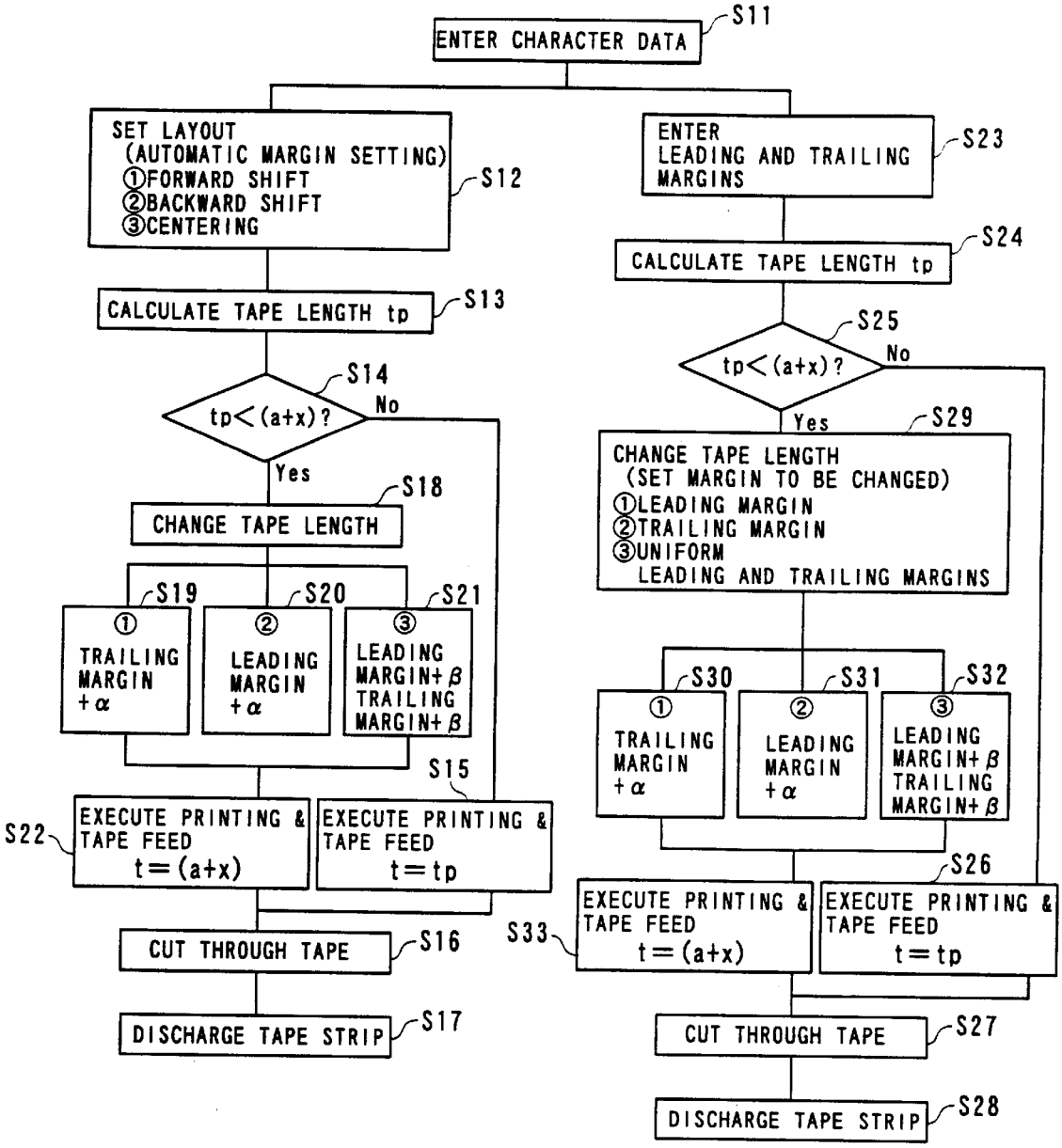
FIG. 5 is a flowchart showing the first embodiment of the invention.

Referring to FIG. 5 showing a flowchart of the present control process, first, character data items of letters, symbols, figures, decorations, and so forth are input by the user via the keyboard 10 (S11). Then, the user selects between whether layout setting for a character portion should be executed based on the input character data and whether numerical input should be executed for designating leading and trailing margins for the character portion. If the execution of layout setting is selected (S12), one of the options of "(1) forward shift", "(2) backward shift" and "(3) centering" is selected to designate the layout. If the option "(1) forward shift" is selected, the character portion is shifted toward the leading end of the tape strip T such that the leading margin becomes smaller in length than the trailing margin, whereas if the option "(2) backward shift" is selected, the character portion is shifted toward the trailing end of the tape strip T such that the leading margin becomes larger in length than the trailing margin. Further, if the option "(3) centering" is selected, the character portion is positioned in the center of the tape strip T such that the leading margin becomes equal in length to the trailing margin.

Then, the lengths of the leading and trailing margins are determined in accordance with the selected layout option, and the calculation tape length tp is calculated (S13). More specifically, if the option "(1) forward shift" is selected, the leading margin is set to 0 mm, and the trailing margin to 8 mm; if the option "(2) backward shift" is selected, the leading margin is set to 8 mm, and the trailing margin to 0 mm; and if the option "(3) centering" is selected, the leading and trailing margins are each set to 4 mm. Although the calculation tape length tp can be obtained by adding the lengths of the leading and trailing margins to the length of the character portion, the length of the character portion depends on the size of characters, a format, and the like, which complicates an equation for calculating the same, and hence description of calculation of the length of the character portion is omitted.

Then, it is determined whether or not the calculation tape length tp is smaller than the length (a+x) obtained by adding the predetermined length x to the length a between the cutting position 16*a* and the exit position 15*a* (S14). If it is determined that tp≧(a+x) holds (No to S14: see FIG. 7A or 7B), printing and tape feed are executed by setting the tape length t to the calculation tape length tp (S15). Then, the tape T is cut manually at the trailing edge of the printed portion thereof (S16), followed by the cut-off strip of the tape T being discharged (S17).

On the other hand, if it is determined that tp<(a+x) holds (Yes to S14: see FIG. 7C), the tape length t is changed (S18). The tape length t is changed by one of the following three methods such that the tape length t becomes equal to (a+x). When "(1) forward shift" was selected in the step S12, a length a is added to the trailing margin in a step S19 (see FIG. 8A). When the option "(2) backward shift" was selected in the step S12, the length a is added to the leading margin in a step S20 (see FIG. 8B). Further, when the option "(3) centering" was selected in the step S12, a length β is added to each of the leading and trailing margins in a step S21 (see FIG. 8C). The length α is a value obtained by an equation of α=(α+x−tp), while the length β is a value obtained by an equation of β=α/2=(a+x−tp)/2. It should be noted that the tape length t is not necessarily required to be changed such that t=(a+x) holds, but it may be changed such that t≧(a+x) holds by setting the values of α and β as such.

The tape length t is changed as described above, and then printing and tape feed are executed (S22). At this time, the tape is fed by the tape length t (=(a+x)). Then, the tape T is cut manually at the trailing edge of the printed portion thereof (S16), followed by the cut-off strip of the tape T being discharged (S17).

Next, description will be given of a case where the user set the leading and trailing margin lengths (S23) instead of executing the layout setting in the step S12. In this case, the user designates the lengths of the leading margin and the trailing margin by numerical input (e.g. 5 mm for the leading margin and 3 mm for the trailing margin) (see FIG. 9A). Then, the calculation tape length tp is calculated (S24) by adding the length of the character portion to the margin lengths. Further, if it is determined that tp≧(a+x) holds (No to S25: see FIG. 7A or 7B), printing and tape feed are carried out (S26) by setting the tape length t to tp. Then, the tape T is cut manually at the trailing edge of the printed portion thereof (S27), followed by the cut-off strip of the tape T being discharged (S28).

On the other hand, if it is determined that tp<(a+x) holds (Yes to S25: see FIG. 9A), the tape length t is changed (S29) such that the tape length t becomes equal to (a+x). The method of changing the tape length t is selected from the following three options ("(1) leading margin", "(2) trailing margin" and "(3) uniform leading and trailing margins"). If the option "(1) leading margin" is selected (S30), the length α is added to the leading margin (see FIG. 9B). If the option "(2) trailing margin" is selected (S31), the length α is added to the trailing margin (see FIG. 9C). Further, if the option "(3) uniform leading and trailing margins" is selected (S32), the length β is added to each of the leading and trailing margins (see FIG. 9D). Also in this tape length-changing process, the tape length t is not necessarily required to be changed such that t=(a+x) holds, but also it may be changed such that t≧(a+x) holds by setting the values of α and β as such.

The value of the tape length t is changed as described above, and then printing and tape feed are executed (S33). In this case, the tape is fed by the tape length t (=(a+x)). Then, the tape T is cut manually at the trailing edge of the printed portion thereof (S27), followed by the cut-off strip of the tape T being discharged (S28).

As described above, according to the first embodiment of the invention, it is determined whether or not the calculation tape length tp is smaller than the length (a+x) obtained by adding the predetermined length x (x≧0) to the length a (a≧0) between the cutting position 16*a* and the exit position 15*a*, and when it is determined that tp<(a+x) holds, the setting of the tape length t is changed such that t=(a+x) (or t≧(a+x)) holds, so that during cutting operation, the tape T is held in a state exposed at least by the length x, which ensures reliable discharge of a tape strip T from the apparatus 1.

Next, as a second embodiment of the invention, a method of reliably discharging a tape strip T (label) from the apparatus 1 by executing "(2) control of operations of the tape feed mechanism" will be described with reference to FIGS. 10 and 11. In this control process, it is determined whether or not the calculation tape length tp is smaller than the length (a+x) obtained by adding the predetermined length x (x≧0) to the length a (a≧0) between the cutting position 16*a* and the exit position 15*a*, and if it is determined that tp≧(a+x) holds, printing is carried out while feeding the tape T by the calculation tape length tp, and then the tape T is cut at the trailing edge of the printed portion thereof. On the other hand, if it is determined that tp<(a+x) holds, printing is carried out while feeding the tape T by the calculation tape length tp, and then the tape T is further fed by a length α{α≧(a+x−tp)} (α>0), followed by being cut at the trailing edge of the printed portion thereof.

Figure 10:
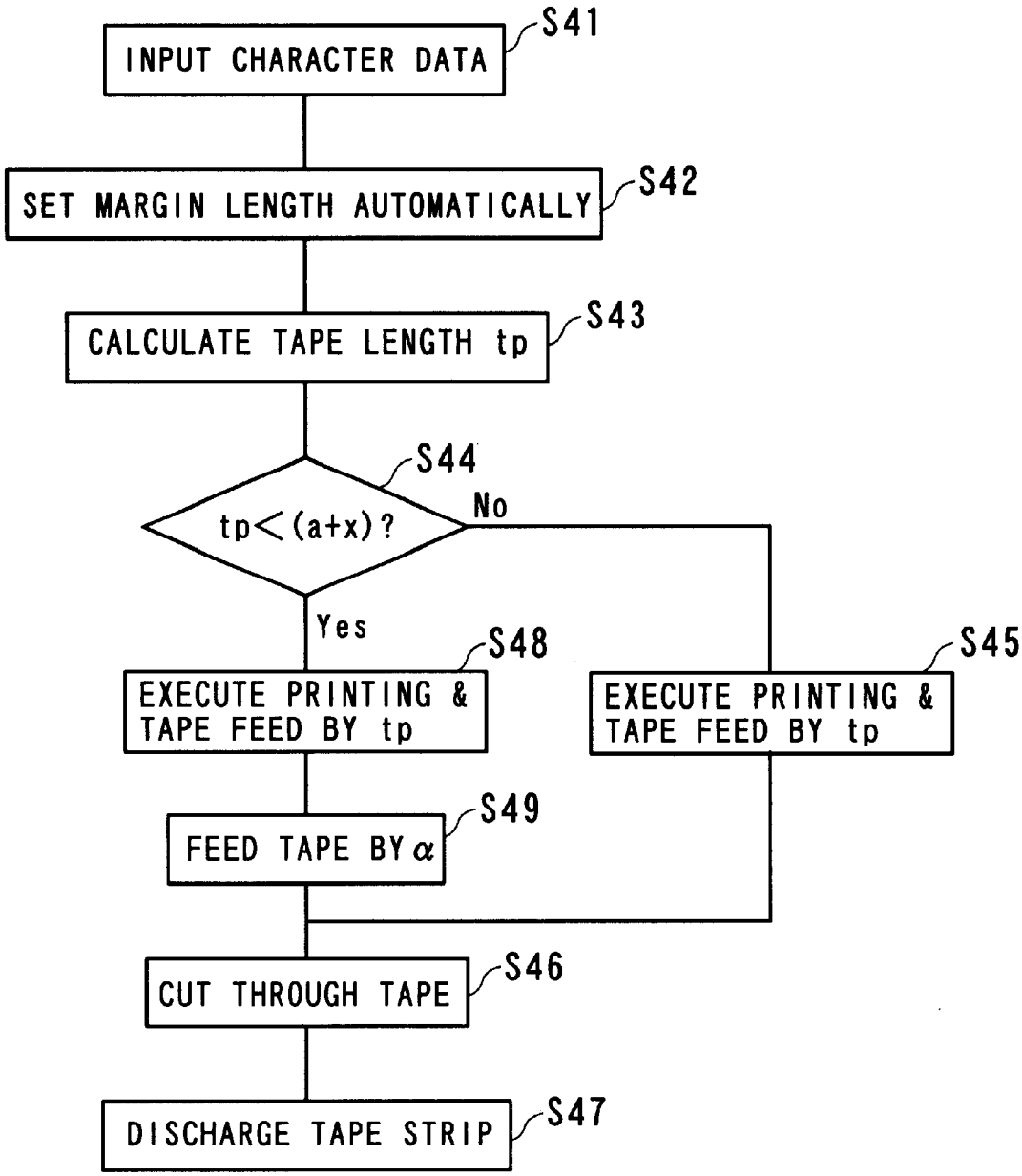
FIG. 10 is a flowchart showing a second embodiment of the invention.
Figures 11A, 11B:
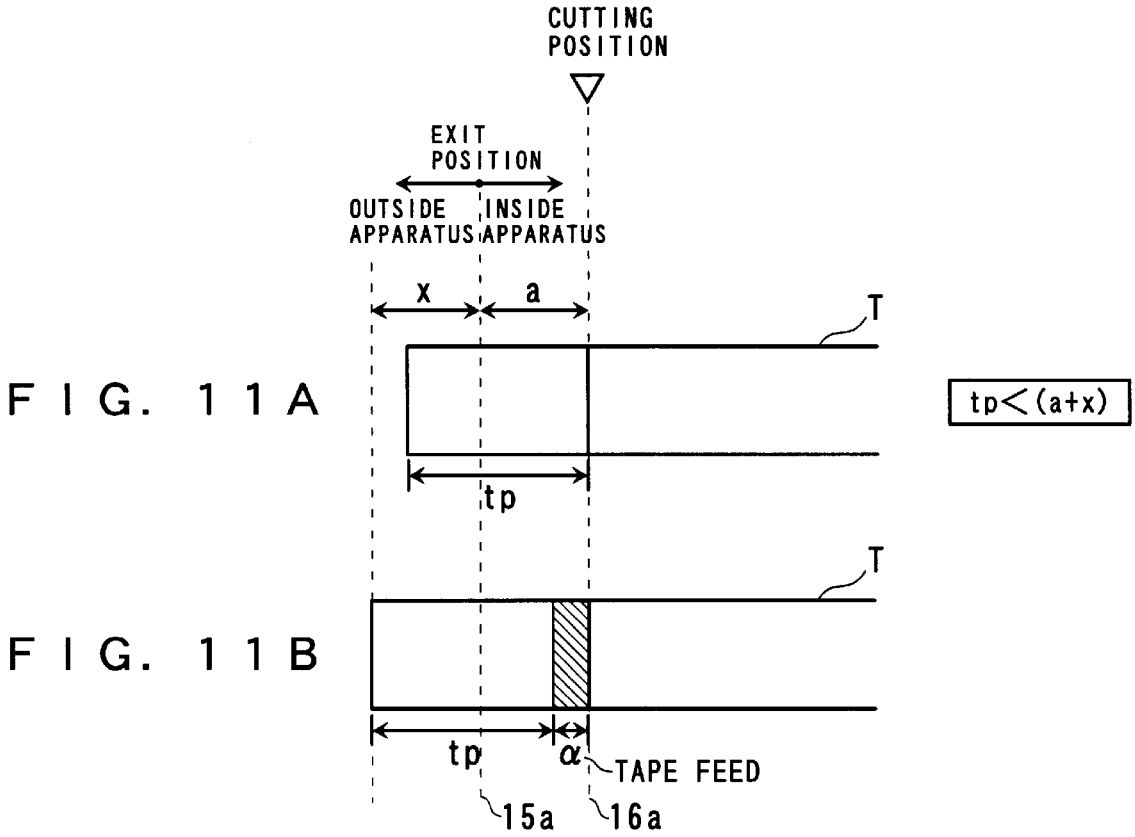
FIGS. 11A and 11B are views useful in explaining tape feed executed after printing.

Referring to FIG. 10 showing a flowchart of the present control process, first, the user enters character data via the keyboard 10 (S41). Then, a margin length is set automatically (S42). The margin length may be set such that the lengths of leading and trailing margins each become equal e.g. to 4 mm, or may be set such that the same can be changed according to a tape length tp calculated in the following step. In the latter case, for instance, by setting each of the leading and trailing margin lengths to 4 mm when the tape length is equal to or smaller than 50 mm, and to 8 mm when the tape length is larger than 50 mm, it is possible to produce a label well balanced as a whole. Alternatively, each margin length may be set to a desired margin length preset by the user.

Then, the calculation tape length tp is calculated (S43) based on the character data input by the user and the margin lengths automatically set, and if it is determined that tp≧(a+x) holds (No to S44: see FIG. 7A or 7B), printing and tape feed are executed such that an actual tape length becomes equal to the calculation tape length tp (S45). Then, the tape T is cut manually at the trailing edge of the printed portion thereof (S46), followed by the cut-off strip of the tape T being discharged (S47).

On the other hand, if it is determined that tp<(a+x) holds (Yes to S44: see FIG. 11A), printing and tape feed are executed (S48) such that an actual tape length becomes equal to (a+x), and then the tape is further fed by the length α (S49). The length α is calculated by using an equation of α=(a+x−tp). It should be noted that the length α may be set such that α≧(a+x−tp) holds. Then, the tape T is cut manually at the trailing edge of the printed portion thereof (S46), followed by the cut-off strip of the tape T being discharged (S47).

Next, a variation of the above embodiment will be described with reference to FIGS. 12 and 13. In this variation, the length b (b≧0) between the printing position 22*a* and the cutting position 16*a* is considered. More specifically, it is determined whether or not a preset leading margin length t1 (t1≧0) is smaller than the length b, and if it is determined that t1<b holds, a leading cut mark is printed before tape feed. Further, if it is determined that (a+x)>(tp+b) holds, the tape T is fed by the length (tp+b), and then a cut mark is printed.

Figure 12:
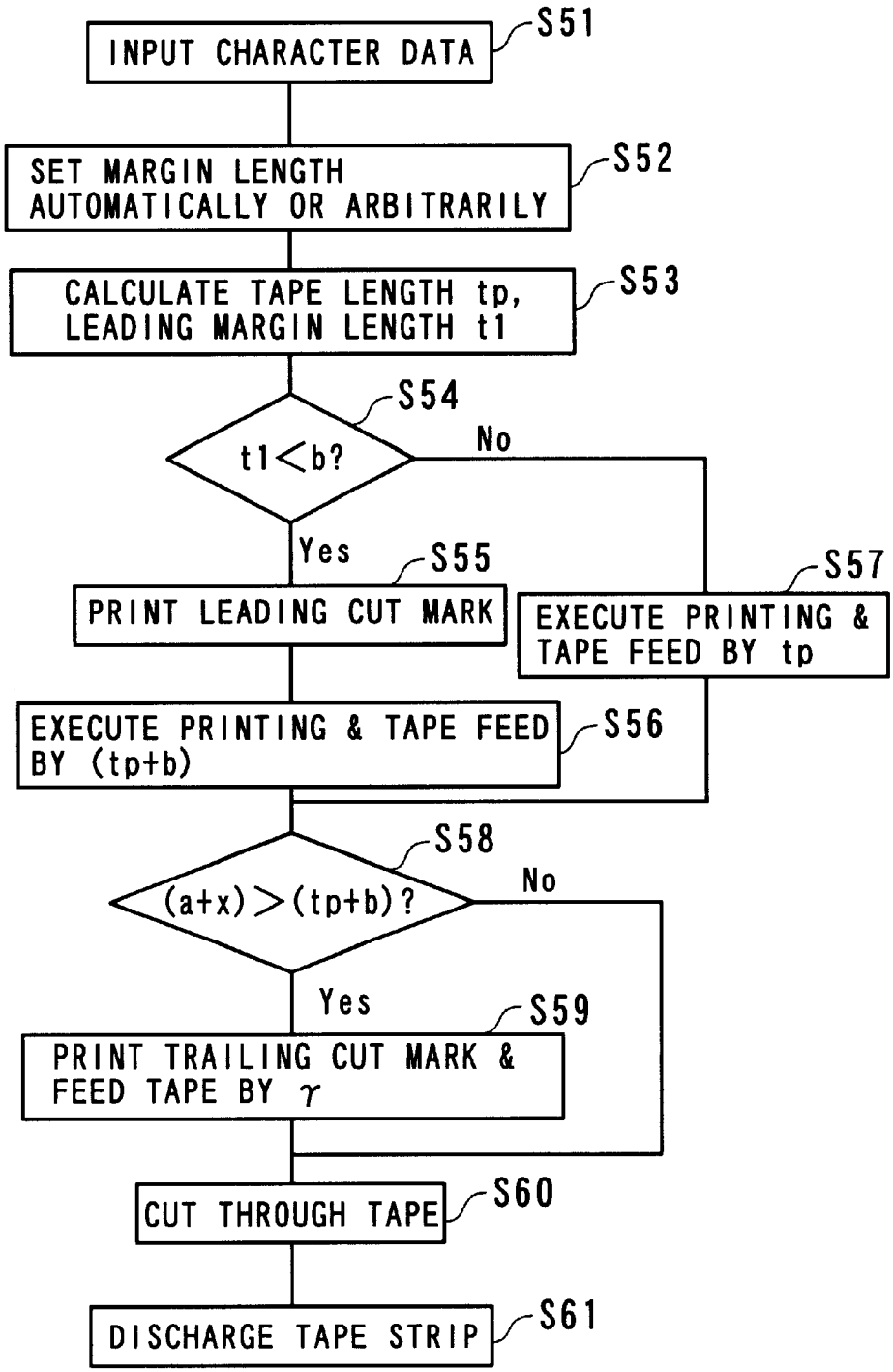
FIG. 12 is a flowchart showing a variation of the second embodiment.

Referring to FIG. 12 showing a flowchart of the present control process, first, the user enters character data via the keyboard 10 (S51). Then, a margin length is set (S52) automatically (see S42 in FIG. 10) or optionally (see S12 to S21 in FIG. 5 and S23 to S32 in the same figure). Then, the calculation tape length tp and the leading margin length t1 are calculated based on the set margin length (S53).

Figures 13A, 13B, 13C, 13D:
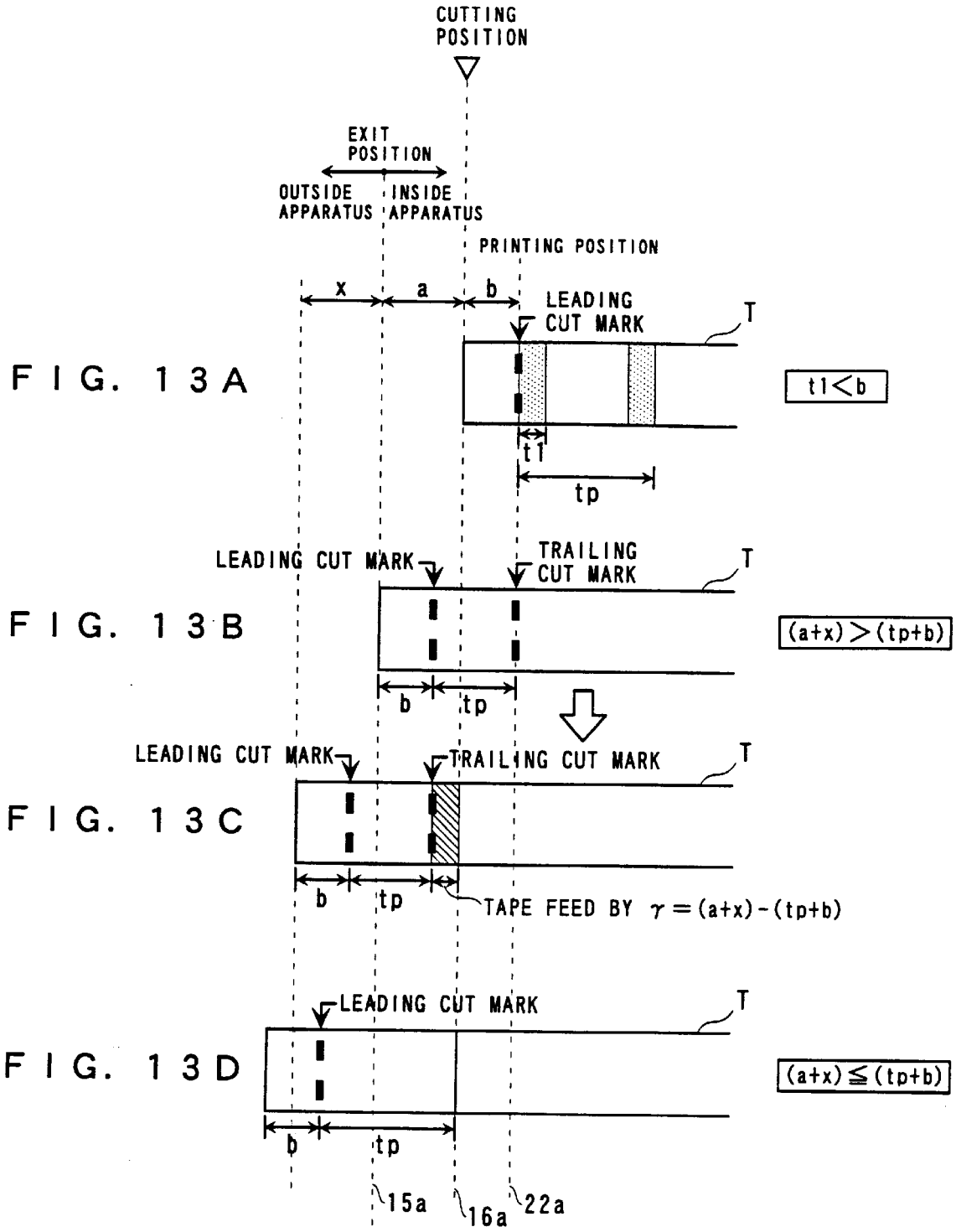
FIGS. 13A to 13D are views useful in explaining printing of cut marks.
Figures 14A, 14B, 14C:
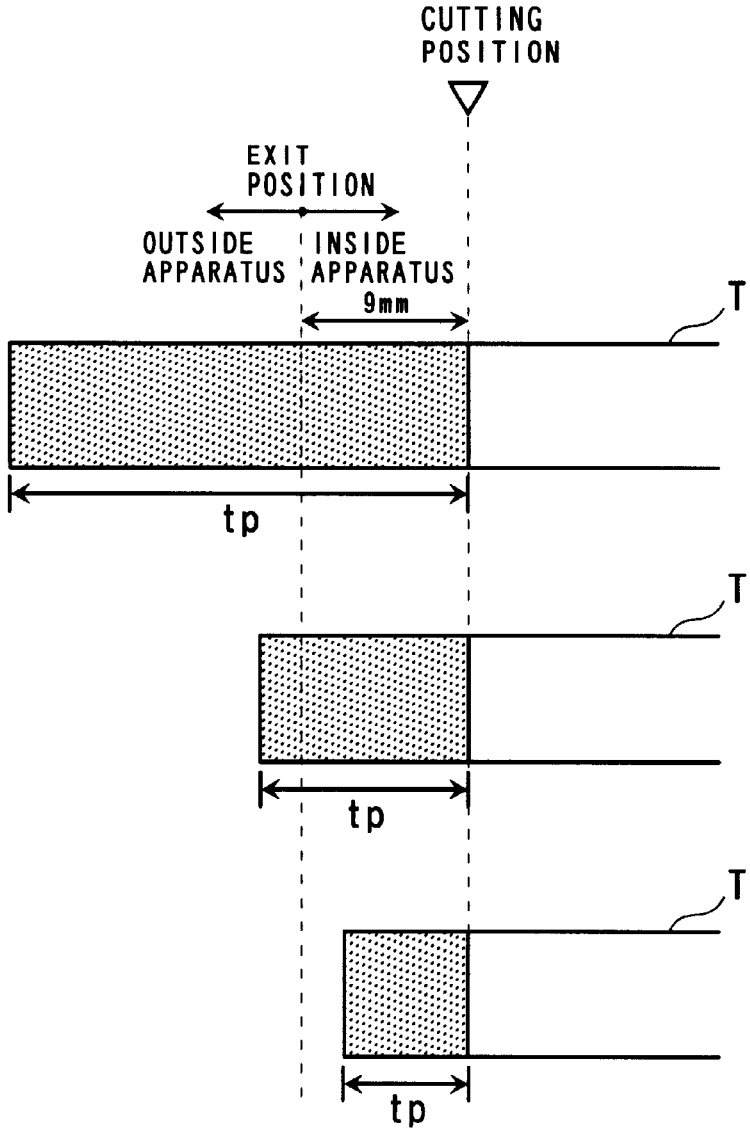
FIGS. 14A to 14C are views useful in explaining the prior art.

Then, it is determined whether or not the calculated leading margin length t1 is smaller than the length b between the printing position 22*a* and the cutting position 16*a*, and if it is determined that t1<b holds (Yes to S54), a leading cut mark is printed (S55: see FIG. 13A). Thereafter, printing and tape feed by the length (tp+b) are executed (S56). On the other hand, if it is determined that t1≧b holds (No to S54), the leading cut mark is not printed, but normal printing (in which the length b is considered to be part of the leading margin length t1) and tape feed by the length tp are executed (S57).

Then, it is determined in a step S58 whether or not the length (a+x) is larger than the length (tp+b), and if it is determined that (a+x)>(tp+b) holds (Yes to S58), a trailing cut mark is printed (see FIG. 13B). Thereafter, the tape is further fed by a length $\gamma\{\gamma=(a+x)-(tp+b)\}$ (S59: see FIG. 13C). It should be noted that the length y may be set such that $\gamma \geqq (a+x)-(tp+b)$ holds. Then, the tape T is cut manually at the trailing edge of the printed portion thereof (S60), followed by the cut-off strip of the tape T being discharged (S61). On the other hand, if it is determined that $(a+x) \leqq (tp+b)$ holds (No to S58), neither printing of the trailing cut mark nor tape feed are executed, but the tape T is cut manually at the trailing edge of the printed portion thereof (S60: see FIG. 13D), followed by the cut-off strip of the tape T being discharged (S61).

As described above, according to the present variation, it is determined whether or not the leading margin length t1 is smaller than the length b between the printing position 22*a* and the cutting position 16*a*, and even if it is determined that the leading margin length t1 is smaller than the length b, a cut mark is printed at the trailing end of an unwanted portion of the leading end portion of the tape, so that after discharge of a cut-off tape strip, the user can cut off the unwanted portion along the cut mark to thereby produce a nice-looking tape strip T (label). Further, when the user uses scissors or the like to cut off the unwanted portion, and particularly when a tape having a large width is employed, the use of a suitable cut mark pattern (e.g. a dot line or a straight line printed along a cutting line) enables the user to cut off the unwanted portion beautifully to produce a nice-looking label having a straight leading edge.

In the above variation, the determination (S54) as to whether the leading margin length t1 is smaller than the length b may be omitted. In this case, a leading cut mark is always printed (S55) before execution of tape feed, and then printing and tape feed are executed (S56) such that the tape length becomes equal to (tp+b) (in short, the steps S54 and S57 may be omitted). According to this method, although the leading portion of the tape always includes an unwanted portion with the length b, the step S54 can be omitted, which makes it possible to simplify the control process.

Further, in place of printing of a cut mark, half-cutting may be performed. More specifically, since the tape T for use in the tape printing apparatus 1 is comprised of an image-receiving layer as a printing surface, an adhesive layer coated on the underside surface of the image-receiving layer, and a peel-off paper covering the adhesive layer, the apparatus 1 may be equipped with a half-cutting function for cutting the tape T except for the peel-off paper, to thereby carry out half-cutting at positions where the above cut mark is printed. According to this method, it is possible not only to reliably discharge a tape strip T from the apparatus 1, but also for the user to obtain a tape strip T with a desired length without using scissors or the like.

As described above, according to the second embodiment of the invention, it is determined whether or not the calculation tape length tp calculated based on the input print data is smaller than the length (a+x) obtained by adding the predetermined length x to the length a between the cutting position 16*a* at which the printed portion of the tape T is cut off and the exit position 15*a* from which the cut-off strip of the tape T is discharged out of the apparatus, and if it is determined that $tp \geqq (a+x)$ holds, printing is carried out while feeding the tape T by the calculation tape length tp, and then the tape T is cut at the trailing edge of the printed portion thereof. On the other hand, if it is determined that $tp<(a+x)$ holds, printing is carried out while feeding the tape T by the calculation tape length tp, and then the tape T is further fed by a length $\alpha\{\alpha \geqq (a+x-tp)\}$ ($\alpha>0$), followed by being cut at the trailing edge of the printed portion thereof. Thus, the tape T is always fed by a length equal to or larger than the length obtained by adding the predetermined length x to the length a between the cutting position 16*a* and the exit position 15*a*. As a result, during cutting operation, the tape T is held in a state exposed at least by the length x, which ensures reliable discharge of a tape strip T from the apparatus 1. Further, the printing of a cut mark or the like enables production of a nice-looking label.

As described above, according to the tape printing apparatus and method of the invention, the calculation tape length tp ($tp>0$) is calculated based on print data input by the user, and then it is determined whether or not the calculation tape length tp is smaller than the length (a+x) obtained by adding the predetermined length x ($x \geqq 0$) to the length a ($a \geqq 0$) between the cutting position 16*a* and the exit position 15*a* from which a cut-off strip of the tape T is discharged out of the apparatus. Then, when it is determined that $tp<(a+x)$ holds, "(1) control for changing setting of the tape length t of a tape strip to be produced" or "(2) control of operation of the tape feed mechanism" is executed, whereby the tape T is caused to be exposed at least by the length x during cutting operation, which ensures reliable discharge of a tape strip T from the apparatus.

Further, since the tape printing apparatus has the tape-retaining means arranged between the cutting position 16*a* and the exit position 15*a*, for preventing displacement of the tape T, cutting of the tape T can be performed stably. Further, when the tape printing apparatus is used by a worker working at a high place e.g. for electric work, the tape-retaining means prevents a cut-off strip of the tape T from falling down during cutting operation. Moreover, the length (x) of the leading end portion of the tape T exposed from the apparatus is set to a length which enables a human to pinch the tape T between his/her fingers, so that the user can hold the leading end of the tape between his/her fingers during cutting operation, which ensures reliable discharge of a cut-off strip of the tape T from the apparatus.

Further, it is determined whether or not the set leading margin length t1 is smaller than the length b between the printing position 22*a* and the cutting position 16*a*, and if it is determine that $t1<b$ holds (i.e. when the leading end portion of the printed portion of the tape includes an unwanted portion having the length b), a leading cut mark is printed before execution of tape feed. Further, if $(a+x)>(tp+b)$ holds (i.e. when the trailing end portion of the printed portion of the tape includes an unwanted portion having the length $\gamma\{\gamma \geqq (a+x)-(tp+b)\}$), a trailing cut mark is printed after the tape T is further fed by the length (tp+b). As a result, after discharge of the cut-off strip of the tape, the user can cut off the unwanted portion along the cut marks to thereby produce a nice-looking tape strip (label).

Although in the above embodiments, cutting operation is carried out manually, the tape printing apparatus may be provided with a cutter motor or the like so as to automatically cut off the printed portion of the tape T fed or advanced to a predetermined position. Further, the cutting operation may be switchable between manual cutting and automatic cutting. This makes it possible to improve operability.

Further, the function key group 10*b* arranged on the keyboard 10 used to input print data may include not only the above-mentioned keys, but also a shift key for use in changing roles of respective keys as well as modifying registered image data, a color specification key for specifying printing colors including neutral colors (mixed colors) of print image data, a color-setting key for setting colors of characters and background colors, an image key for alternately switching between a text input screen or a selection screen and a display screen (image screen) for displaying print image data, a proportion-changing (zoom) key for changing a proportion between the size of print image data and the size of display image data displayed on the image screen, and a form key for setting formats of labels to be formed. Furthermore, similarly to keyboards of the general type, the above key entries may be made by separate keys exclusively provided for respective key entries or by a smaller number of keys operated in combination with the shift key or the like. This makes it possible to produce various kinds of labels further meeting the user's needs.

Although in the above embodiments, the invention is applied to a handy type tape printer, this is not limitative, but the invention is applicable to other types of printing apparatus.

It is further understood by those skilled in the art that the foregoing are preferred embodiments of the invention, and that various changes and modification may be made without departing from the spirit and scope thereof.

What is claimed is:

1. A tape printing apparatus that is capable of producing a tape strip having a desired tape length by printing on a tape while feeding the tape and then cutting the tape at a trailing end of a printed portion thereof, the tape printing apparatus comprising:

tape feed means for feeding the tape;

printing means for printing on the tape;

print data input means for inputting print data to be printed by said printing means;

tape length-calculating means for calculating a calculation tape length tp (tp>0) based on the print data input via said print data input means;

tape length-setting means for setting a tape length t based on the calculation tape length tp calculated by said tape length-calculating means;

cutter means for cutting the tape to the tape length t set by said tape length-setting means; and determining means for determining whether the calculation tape length tp is smaller than a length (a+x) obtained by adding a predetermined length x ($x \geqq 0$) to a length a ($a \geqq 0$) between a cutting position at which the tape is cut through by said cutter means and a position of an exit via which a cut-off strip of the tape is discharged out of the tape printing apparatus, wherein if said determining means has determined that the calculation tape length tp is smaller than the length (a+x), said tape length-setting means sets the tape length t such that the tape length t becomes equal to or larger than the length (a+x), whereas if said determining means has determined that the tape length t is not smaller than the length (a+x), said tape length-setting means sets the tape length t to the calculation tape length tp.

2. A tape printing apparatus according to claim 1, wherein said print data input means is capable of inputting the print data formed of character data to be printed, leading margin data indicative of a length of a leading margin of the tape strip, and trailing margin data indicative of a length of a trailing margin of the tape strip.

3. A tape printing apparatus according to claim 1, wherein said print data input means is capable of inputting character data to be printed, and the print data is formed of the character data, and leading margin data and trailing margin data indicative of respective predetermined lengths of leading and trailing margins of the tape strip.

4. A tape printing apparatus according to claim 3, further comprising character position-setting means for setting layout of a character portion to be printed based on the character data, and wherein the predetermined lengths indicated by the leading margin data and the trailing margin data, respectively, are set according to the layout of the character portion set by said character position-setting means.

5. A tape printing apparatus according to claim 4, wherein the layout of the character portion includes at least one of forward shift, backward shift, and centering.

6. A tape printing apparatus according to claim 2 or 3, wherein when said determining means has determined that the calculation tape length tp is smaller than the length (a+x), said tape length-setting means adds a length $\alpha\{\alpha \geqq (a+x-tp)\}$ ($\alpha>0$) to the length indicated by any one of the leading margin data and the trailing margin data, to thereby set the tape length t such that the tape length t becomes equal to or larger than the length (a+x).

7. A tape printing apparatus according to claim 6, wherein the length a is determined by using an equation of $\alpha=a+x-tp$.

8. A tape printing apparatus according to claim 2 or 3, wherein when said determining means has determined that the calculation tape length tp is smaller than the length (a+x), said tape length-setting means adds a length $\beta[\beta>\{(a+x-tp)/2\}]$ ($\beta>0$) to each of the lengths indicated by the leading margin data and the trailing margin data, to thereby set the tape length t such that the tape length becomes equal to or larger than the length (a+x) holds.

9. A tape printing apparatus according to claim 8, wherein the length $\beta$ is determined by using an equation of $\beta=(a+x-tp)/2$.

10. A tape printing apparatus according to claim 1, wherein the predetermined length x is a length which enables a human to pinch the tape between his/her fingers.

11. A tape printing apparatus that is capable of producing a tape strip having a desired tape length by printing on a tape while feeding the tape and then cutting the tape at a trailing end of a printed portion thereof, the tape printing apparatus comprising:

tape feed means for feeding the tape;

printing means for printing on the tape;

print data input means for inputting print data to be printed by said printing means;

tape length-calculating means for calculating a calculation tape length tp (tp>0) based on the print data input via said print data input means;

cutter means for cutting the tape based on the calculation tape length tp calculated by said tape length-calculating means; and determining means for determining whether or not the calculation tape length tp calculated by said tape length-calculating means is smaller than a length (a+x) obtained by adding a predetermined length x ($x \geqq 0$) to a length a ($a \geqq 0$) between a cutting position at which the tape is cut through by said cutter means and a position of an exit via which a cut-off strip of the tape is discharged out of the tape printing apparatus, wherein if said determining means has determined that the calculation tape length tp is not smaller than the length (tp+b), said printing means carries out printing while said tape feed means feeds the tape by the length tp, and then said cutter means cuts the tape at a trailing end of the printed portion thereof, and if said determining means has determined that the calculation tape length tp is smaller than the length (a+x), said printing means carries out printing while said tape feed means feeds the tape by the length tp, and then said tape feed means alone operates to further feed the tape by a length $\alpha\{\alpha \geqq (a+x-tp)\}$ ($\alpha>0$), followed by said cutter means cutting the tape at a trailing end of the printed portion thereof.

12. A tape printing apparatus according to claim 11, wherein when said determining means has determined that the calculation tape length tp is smaller than the length (a+x), said tape feed means feeds the tape by the length tp, and then said printing means prints a cut mark on the tape.

13. A tape printing apparatus according to claim 11, wherein the length a is determined by using an equation of $\alpha=a+x-tp$.

14. A tape printing apparatus according to claim 11, wherein the predetermined length x is a length which enables a human to pinch the tape between his/her fingers.

15. A tape printing apparatus that is capable of producing a tape strip having a desired tape length by printing on a tape while feeding the tape and then cutting the tape at a trailing end of a printed portion thereof at a location downstream of a location where printing is carried out, the tape printing apparatus comprising:

tape feed means for feeding the tape;

printing means for printing on the tape;

print data input means for inputting print data to be printed by said printing means;

tape length-calculating means for calculating a calculation tape length tp (tp>0) based on the print data input via said print data input means;

cutter means for cutting the tape based on the calculation tape length tp set by said tape length-setting means; and determining means for determining whether or not a length (a+x) obtained by adding a predetermined length x ($x \geqq 0$) to a length a ($a \geqq 0$) between a cutting position at which the tape is cut through by said cutter means and a position of an exit via which a cut-off strip of the tape is discharged out of the tape printing apparatus is larger than a length (tp+b) obtained by adding a length b ($b \geqq 0$) between a printing position at which printing is carried out by said printing means and the cutting position to the calculation tape length tp, wherein if said determining means has determined that the length (a+x) is not larger than the length (tp+b), said printing means carries out the printing while said tape feed means feeds the tape by the length (tp+b), and then said cutter means cuts the tape at a trailing end of the printed portion thereof, and if said determining means has determined that length (a+x) is larger than the length (tp+b), said printing means carries out the printing while said tape feed means feeds the tape by the length (tp+b), and then said tape feed means alone operates to further feed the tape by a length $\gamma\{\gamma \geqq (a+x)-(tp+b)\}$ ($\gamma>0$), followed by said cutter means cutting the tape at a trailing end of the printed portion thereof.

16. A tape printing apparatus according to claim 15, wherein the print data is formed of character data to be printed, leading margin data indicative of a length of a leading margin of the tape strip, and trailing margin data indicative of a length of a trailing margin of the tape strip, wherein the tape printing apparatus further comprises second determining means for determining whether or not a length t1 ($t1 \geqq 0$) indicated by the leading margin data is smaller than the length b ($b \geqq 0$) between the printing position and the cutting position, and wherein if said second determining means has determined that the length t1 is smaller than the length b, said printing means prints a cut mark on the tape before the tape is fed by said tape feed means.

17. A tape printing apparatus according to claim 15, wherein if said determining means has determined that the length (a+x) is larger than the length (tp+b), said tape feed means feeds the tape by the length (tp+b), and then said printing means prints a cut mark on the tape.

18. A tape printing apparatus according to claim 15, wherein the length $\gamma$ is obtained by an equation of $\gamma=(a+x)-(tp+b)$.

19. A tape printing apparatus according to claim 15, wherein the predetermined length x is a length which enables a human to pinch the tape between his/her fingers.

20. A tape printing apparatus according to any one of claims 1, 11 or 15, wherein said cutter means comprises a cutter blade and a retaining portion for retaining the cutter blade, the tape fed between said cutter blade and said retaining portion being cut by force-cutting through actuation of said cutter blade, the tape printing apparatus further comprising tape-retaining means arranged between the cutting position at which the tape is cut through and the position of the exit via which the cut-off strip of the tape is discharged out of the tape printing apparatus, for retaining the tape to prevent the tape from being displaced by cutting operation of said cutter blade.

21. A tape printing apparatus according to claim 20, wherein said tape-retaining means retains the tape portion prior to the cutting operation in which said cutter blade is brought into contact with said retaining portion, and after completion of the cutting operation of said cutter blade, releases the tape subsequent to a return motion of said cutter blade moving away from said retaining portion.

22. A tape printing apparatus according to any one of claims 1, 11 or 15, wherein the tape is contained in a cartridge in a state wound into a roll, and wherein the tape printing apparatus includes a cartridge compartment in which the cartridge is accommodated.

23. A tape printing method for a tape printing apparatus that is capable of producing a tape strip having a desired tape length by printing on a tape while feeding the tape and then cutting the tape at a trailing end of a printed portion thereof, the tape printing method comprising the steps of:

inputting print data to be printed;

calculating a calculation tape length tp (tp>0) based on the input print data;

determining whether the calculation tape length tp is smaller than a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus;

setting the tape length t such that the tape length t becomes equal to or larger than the length (a+x) if it is determined that the calculation tape length tp is smaller than the length (a+x), and setting the tape length t to the calculation tape length tp if it is determined that the calculation tape length tp is not smaller than the length (a+x); and cutting the tape to the set tape length t.

24. A tape printing method for a tape printing apparatus that is capable of producing a tape strip having a desired tape length by printing on a tape while feeding the tape and then cutting the tape at a trailing end of a printed portion thereof, the tape printing method comprising the steps of:

inputting print data to be printed;

calculating a calculation tape length tp (tp>0) based on the input print data;

determining whether or not the calculation tape length tp is smaller than a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus; and carrying out printing while feeding the tape by the calculation tape length tp, and then cutting the tape at a trailing end of the printed portion thereof if it is determined that the calculation tape length tp is not smaller than the length (tp+b), or carrying out printing while feeding the tape by the length tp, and then further feeding the tape by a length $\alpha\{\alpha \geqq (a+x-tp)\}$ (a>0), followed by cutting the tape at a trailing end of the printed portion thereof if it is determined that the calculation tape length tp is smaller than the length (a+x).

25. A tape printing method for a tape printing apparatus that is capable of producing a tape strip having a desired tape length by printing on a tape while feeding the tape and then cutting the tape at a trailing end of a printed portion thereof at a location downstream of a location where printing is performed, the tape printing method comprising the steps of:

inputting print data to be printed;

calculating a calculation tape length tp (tp>0) based on the input print data;

determining whether or not a length (a+x) obtained by adding a predetermined length x ($x \geqq 0$) to a length a ($a \geqq 0$) between a cutting position at which the tape is cut through and a position of an exit via which a cut-off strip of the tape is discharged out of the tape printing apparatus is larger than a length (tp+b) obtained by adding a length b ($b \geqq 0$) between a printing position at which printing is carried out and the cutting position to the calculation tape length tp; and carrying out printing while feeding the tape by the length (tp+b), and then cutting the tape at a trailing end of the printed portion thereof if it is determined that the length (a+x) is not larger than the length (tp+b), or carrying out printing while feeding the tape by the length (tp+b), and then further feeding the tape by a length $\gamma\{\gamma \geqq (a+x)-(tp+b)\}$ ($\gamma>0$), followed by cutting the tape at a trailing end of the printed portion thereof, if it is determined that the length (a+x) is larger than the length (tp+b).

* * * * *